US011813875B2

(12) United States Patent
Kishii

(10) Patent No.: US 11,813,875 B2
(45) Date of Patent: Nov. 14, 2023

(54) LIQUID EJECTING SYSTEM AND LIQUID STORAGE MECHANISM

(71) Applicant: SEIKO EPSON CORPORATION, Tokyo (JP)

(72) Inventor: Yoshiaki Kishii, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 141 days.

(21) Appl. No.: 17/351,972

(22) Filed: Jun. 18, 2021

(65) Prior Publication Data

US 2021/0394526 A1 Dec. 23, 2021

(30) Foreign Application Priority Data

Jun. 22, 2020 (JP) ..... 2020-106783

(51) Int. Cl.
*B41J 2/175* (2006.01)
*B41J 2/165* (2006.01)

(52) U.S. Cl.
CPC ..... *B41J 2/17596* (2013.01); *B41J 2/16505* (2013.01)

(58) Field of Classification Search
CPC ..... B41J 2/17596; B41J 2/16505
See application file for complete search history.

(56) References Cited

U.S. PATENT DOCUMENTS 5,623,290 A 4/1997 Iida et al.
6,315,402 B1 11/2001 Kawase
2006/0007254 A1 1/2006 Tanno et al.
2008/0273048 A1 11/2008 Naka et al.
2009/0213159 A1 8/2009 Aoki et al.
2012/0200646 A1 8/2012 Karasawa et al.
2013/0307908 A1 11/2013 Aoki et al.

FOREIGN PATENT DOCUMENTS

JP S63057238 A 3/1988
JP 2000141687 A 5/2000
JP 2002052731 A 2/2002
JP 2004203056 A 7/2004
JP 2006021383 A 1/2006
JP 2006044015 A 2/2006
JP 2006205554 A 8/2006
JP 2007182086 A 7/2007
JP 2009214418 A 9/2009
JP 2009220564 A 10/2009
JP 2010012657 A 1/2010
JP 2012144037 A 8/2012
JP 2016137729 A 8/2016
JP 2016164003 A 9/2016
JP 2017109495 A 6/2017
JP 2018001644 A 1/2018
WO WO-2005000684 A2 * 1/2005 ..... B41J 2/17513

* cited by examiner

*Primary Examiner* — Justin Seo
(74) *Attorney, Agent, or Firm* — CHIP LAW GROUP

(57) ABSTRACT

A liquid ejecting system includes a liquid storage mechanism including a liquid storage portion provided in a liquid supply channel that can supply liquid in a liquid supply source to a liquid ejecting portion, and a second negative pressure larger than a first negative pressure is generated in the liquid storage portion when a storage amount of the liquid in the liquid storage portion becomes smaller than a set predetermined amount, the first negative pressure being a negative pressure that is generated in the liquid supply source when a remaining amount of the liquid in the liquid supply source becomes small.

11 Claims, 14 Drawing Sheets

LIQUID EJECTING SYSTEM AND LIQUID STORAGE MECHANISM

The present application is based on, and claims priority from JP Application Serial Number 2020-106783, filed Jun. 22, 2020, the disclosure of which is hereby incorporated by reference herein in its entirety.

BACKGROUND

1. Technical Field

The present disclosure relates to a liquid ejecting system and a liquid storage mechanism of a printer or the like.

2. Related Art

In the related art, a liquid consumption apparatus that is an example of a liquid ejecting system in which ink supplied from a cartridge through a supply channel is ejected from an ejecting nozzle of a head that is an example of a liquid ejecting portion to print an image is known, as disclosed in JP-A-2016-164003. Here, the ink end is detected based on a negative pressure that is generated when the liquid in a liquid housing part of the cartridge becomes small.

In the liquid consumption system disclosed in JP-A-2016-164003, however, the liquid ejecting at the liquid ejecting portion cannot be continued when the remaining amount of the liquid in the liquid supply source becomes small during the liquid ejecting at the liquid ejecting portion.

SUMMARY

A liquid ejecting system includes a liquid ejecting portion configured to eject liquid, a liquid feeding mechanism configured to supply the liquid in a liquid supply source to the liquid ejecting portion through a liquid supply channel, the liquid feeding mechanism being provided in the liquid supply channel, and a liquid storage mechanism including a liquid storage portion configured to store the liquid supplied from the liquid supply source and provided between the liquid supply source and the liquid feeding mechanism in the liquid supply channel. The liquid storage portion includes a flexible part having flexibility. The liquid storage mechanism generates a second negative pressure larger than a first negative pressure in the liquid storage portion when a storage amount of the liquid in the liquid storage portion becomes smaller than a set predetermined amount, the first negative pressure being a negative pressure that is generated in the liquid supply source when a remaining amount of the liquid in the liquid supply source becomes small.

A liquid storage mechanism includes a liquid storage portion provided between a liquid supply source and a liquid feeding mechanism in a liquid supply channel configured to supply liquid in the liquid supply source to a liquid ejecting portion configured to eject liquid, the liquid feeding mechanism being configured to feed the liquid toward the liquid ejecting portion. The liquid storage portion includes a flexible part having flexibility and is configured to store the liquid supplied from the liquid supply source. A second negative pressure larger than a first negative pressure is generated in the liquid storage portion when a storage amount of the liquid in the liquid storage portion becomes smaller than a set predetermined amount, the first negative pressure being a negative pressure that is generated in the liquid supply source when a remaining amount of the liquid in the liquid supply source becomes small.

DESCRIPTION OF EXEMPLARY EMBODIMENTS

1. Embodiment 1

An embodiment 1 of a liquid ejecting system is described below with reference to the drawings. The liquid ejecting system is, for example, an ink-jet printer for printing images of letters, photographs and the like by ejecting ink, which is an example of liquid, to a medium such as a sheet.

Figure 1:
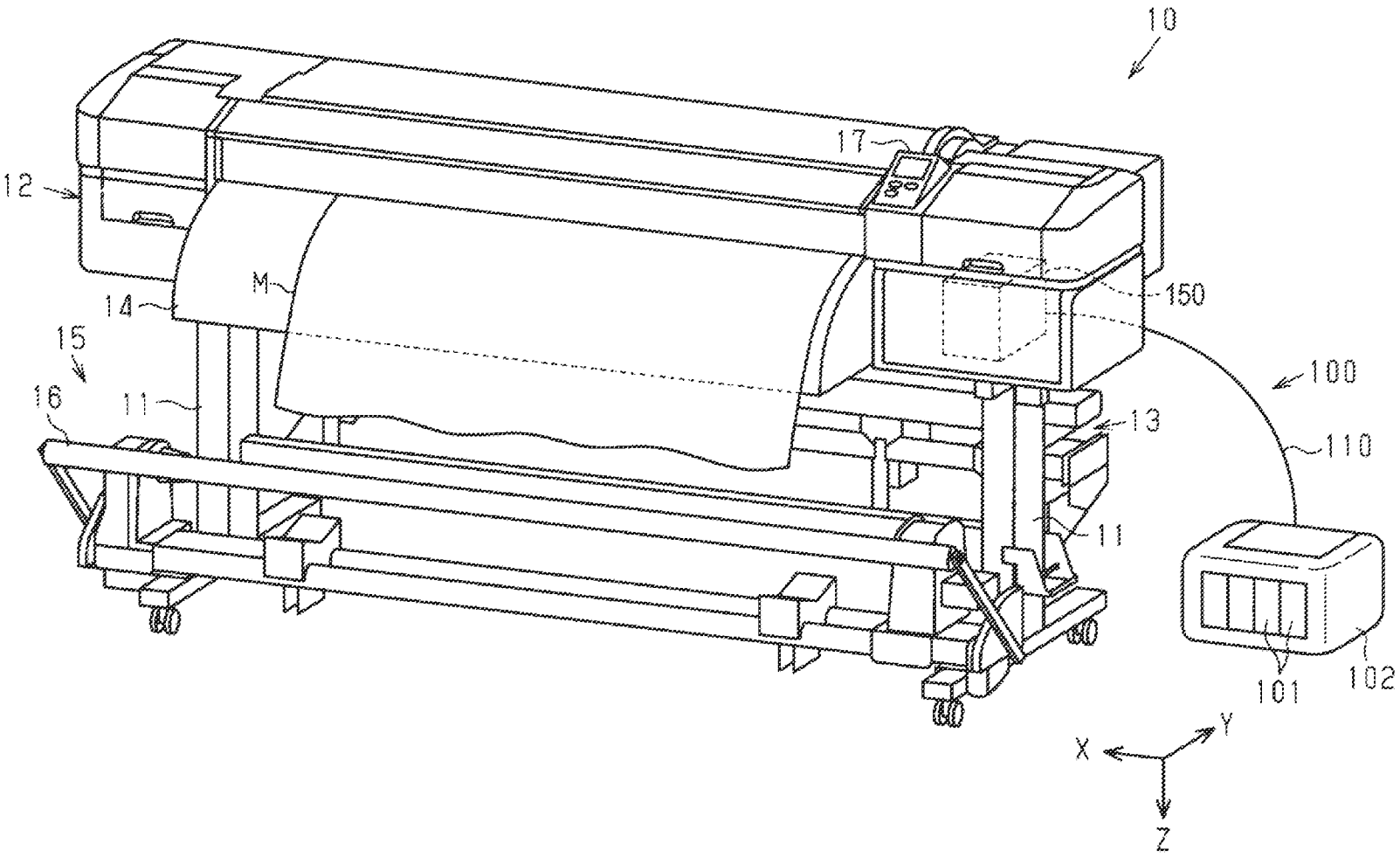
FIG. 1 is a perspective view illustrating a liquid ejecting system according to an embodiment 1.

As illustrated in FIG. 1, a liquid ejecting system 10 includes a pair of leg parts 11, and a housing 12 mounted on the leg parts 11. The liquid ejecting system 10 includes a feeding portion 13 that sends out a medium M toward the housing 12, a guide part 14 that guides the medium M ejected from the housing 12, and a winding part 15 that winds the medium M guided by the guide part 14 on a roll body. The liquid ejecting system 10 includes a tension application mechanism 16 that applies a tension to the medium M wound by the winding part 15, and an operation panel 17 that is operated by the user.

The liquid ejecting system 10 has a predetermined length as the width, the depth and the height in the state where it is disposed at the place where it is used. On the assumption that the liquid ejecting system 10 is disposed on a horizontal plane, the gravity direction is indicated as the Z-axis direction. Here, the width direction and the depth direction of the liquid ejecting system 10 are substantially horizontal. The depth direction of the liquid ejecting system 10 is indicated as the Y-axis direction. The width direction of the liquid ejecting system 10 is indicated as the X-axis direction that intersects the Y axis and the Z axis. Thus, the X axis, the Y axis and the Z axis serve as coordinate axes representing the width, the depth and the height, respectively.

Figure 2:
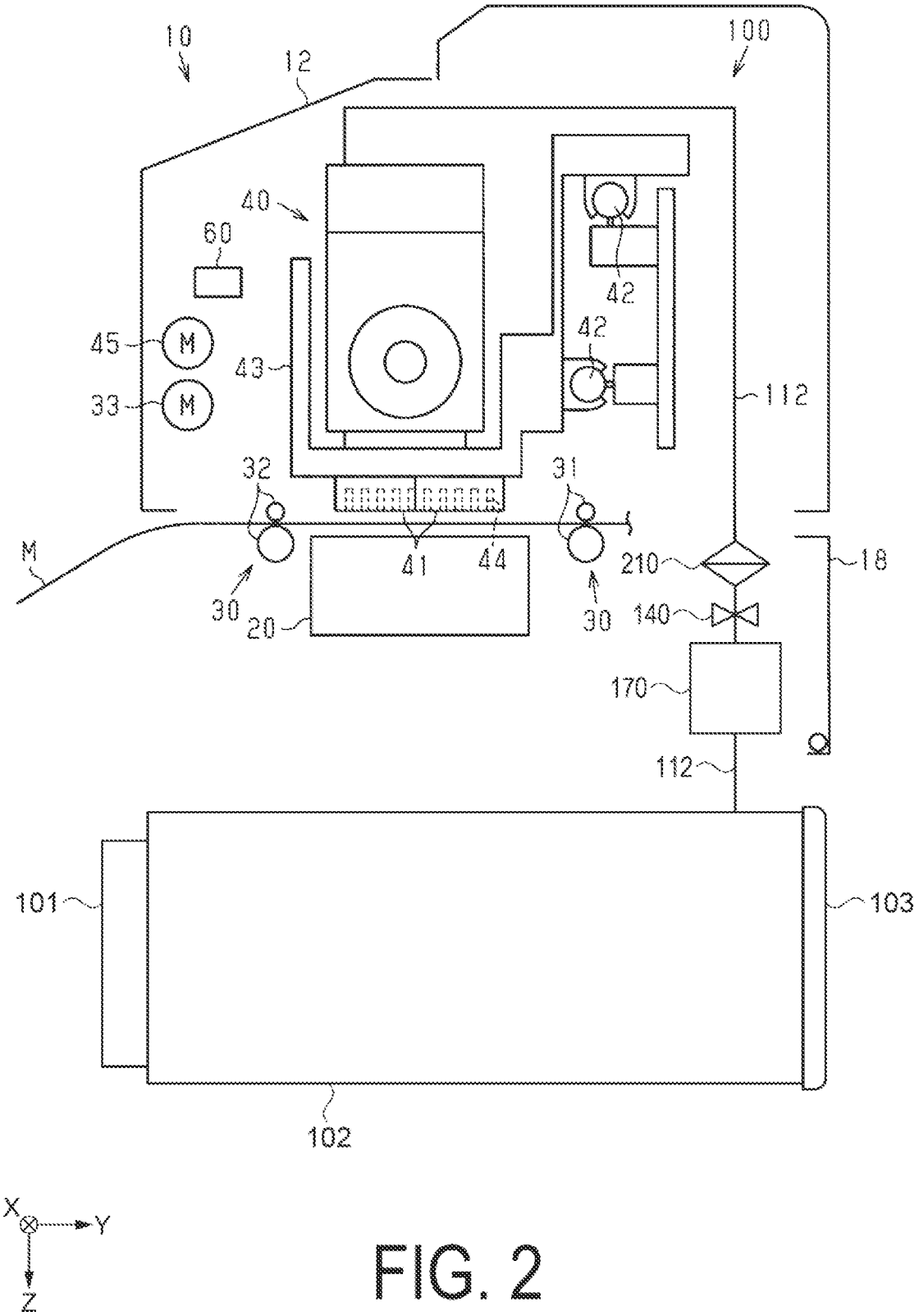
FIG. 2 is a schematic sectional view illustrating an internal configuration of the liquid ejecting system according to the embodiment 1.

As illustrated in FIG. 2, the liquid ejecting system 10 includes a support stand 20 that supports the medium M, and a conveyance portion 30 that conveys the medium M. The liquid ejecting system 10 includes a printing portion 40 that performs printing on the medium M, and a control portion 60 that controls the operation of the liquid ejecting system 10. The liquid ejecting system 10 includes a liquid supply apparatus 100 that supplies liquid to the printing portion 40. The control portion 60 includes, for example, a CPU, a memory and the like. The control portion 60 controls the liquid ejecting system 10 and the liquid supply apparatus 100 by executing a program stored in the memory using the CPU.

The support stand 20 extends in the width direction. In the present embodiment, the width direction of the liquid ejecting system 10 coincides with the width direction of the medium M. On the support stand 20, the medium M is conveyed in a direction opposite to the depth direction. That is, the conveyance direction of the medium M is opposite to the depth direction.

The conveyance portion 30 includes a conveyance roller pair 31 located on the depth side than the support stand 20 in the depth direction, and a conveyance roller pair 32 located on the near side than the support stand 20 in the depth direction. The conveyance portion 30 includes a conveyance motor 33 that drives the conveyance roller pair 31 and the conveyance roller pair 32. When the conveyance roller pair 31 and the conveyance roller pair 32 are driven by the conveyance motor 33, the medium M sandwiched by the conveyance roller pair 31 and the conveyance roller pair 32 is conveyed along the surface of the support stand 20 in the conveyance direction.

The printing portion 40 includes a liquid ejecting portion 41 that ejects liquid from a nozzle 44. The printing portion 40 of the present embodiment includes a guide shaft 42 provided to extend in the width direction, and a carriage 43 configured to reciprocate in the width direction by being guided by the guide shaft 42.

The printing portion 40 includes a carriage motor 45 for moving the carriage 43 along the guide shaft 42. The carriage 43 moves along with the driving of the carriage motor 45. That is, the liquid ejecting system 10 of the present embodiment is of a serial type in which the liquid ejecting portion 41 performs scanning with respect to the medium M. The liquid ejecting system 10 may be configured as a line type in which the liquid ejecting portion 41 is elongated in the width direction.

Figure 3A:
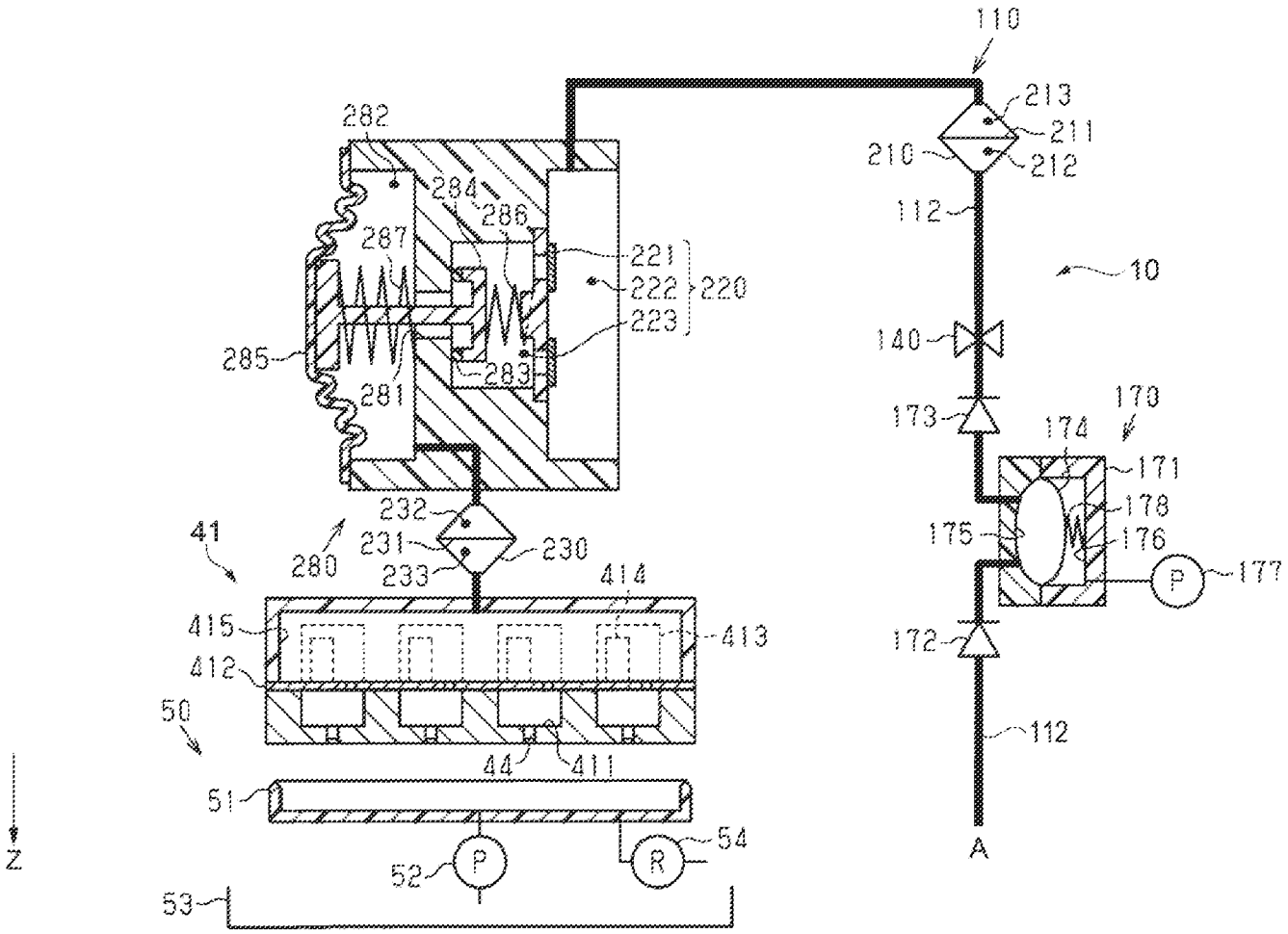
FIG. 3A is a schematic sectional view illustrating a configuration of the liquid ejecting system and a liquid supply apparatus according to the embodiment 1.

As illustrated in FIG. 3A, the liquid ejecting portion 41 includes one or a plurality of the nozzles 44 that eject liquid. The liquid ejecting portion 41 includes an individual liquid chamber 411 communicated with the nozzle 44, a housing part 413 that is separated from the individual liquid chamber 411 by a vibration plate 412, and an actuator 414 housed in the housing part 413. The liquid ejecting portion 41 includes a common liquid chamber 415 that temporarily stores the supplied liquid and supplies the liquid to a plurality of the individual liquid chambers 411.

The actuator 414 is, for example, a piezoelectric element that shrinks when a drive voltage is applied thereto. When the application of the drive voltage is stopped after the vibration plate 412 is deformed along with the shrinkage of the actuator 414, the liquid inside the individual liquid chamber 411 whose volume has been changed is ejected as droplets from the nozzle 44.

As illustrated in FIG. 2, the liquid supply apparatus 100 includes a liquid supply source holding portion 102 that holds a liquid supply source 101 serving as a liquid supply source for the liquid ejecting portion 41. The liquid supply source 101 of the present embodiment is of a cartridge type in which when the remaining amount of the liquid in the liquid supply source 101 becomes small, it is determined to be an ink end and replacement is performed. For example, the liquid supply source 101 may be of a tank type that can be replenished with liquid as long as it has a configuration that can house liquid. The liquid supply source 101 corresponding to the number of the types of the liquid used by the liquid ejecting system 10 is provided.

The liquid supply apparatus 100 includes a liquid supply channel 110 that can supply the liquid in the liquid supply source 101 to the liquid ejecting portion 41. It suffices that the liquid supply channel 110 is a channel that can carry liquid. The liquid supply channel 110 may be formed of an elastically-deformable tube, or a channel formation member made of a hard resin material, for example. The liquid supply channel 110 may be formed by bonding a film member to a channel formation member in which a groove is formed.

Figure 3B:
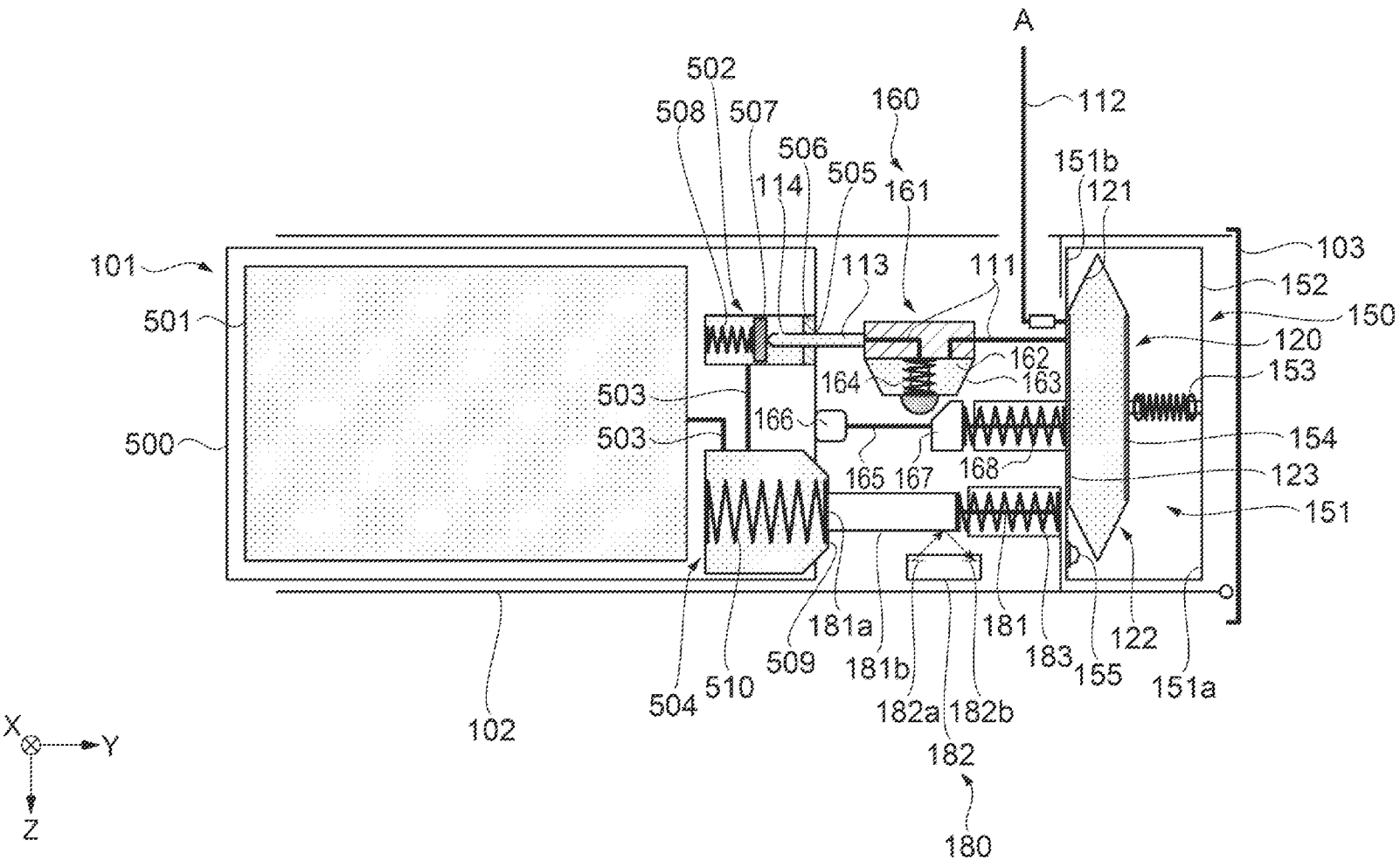
FIG. 3B is a schematic sectional view illustrating configurations of the liquid ejecting system and the liquid supply apparatus according to the embodiment 1.

As illustrated in FIG. 3B, the liquid supply source 101 may include, in a housing case 500, a liquid housing part 501 that houses liquid, a liquid outlet portion 502 that outputs the liquid in the liquid housing part 501, and a liquid pressure detection portion 504 provided in a liquid outlet channel 503 that couples the liquid housing part 501 and the liquid outlet portion 502. The liquid outlet portion 502 may include a sealing member 506 in which a liquid outlet port 505 that outputs liquid is provided, a valve element 507 that can open and close the liquid outlet port 505, and a press spring 508 that presses the valve element 507 toward the liquid outlet port 505. The liquid pressure detection portion 504 may include a displacement wall 509 that is displaced by the negative pressure generated in accordance with the remaining amount of the liquid in the liquid housing part 501, and a push spring 510 that pushes the displacement wall 509 in the direction in which the volume in the liquid pressure detection portion 504 increases.

The liquid supply apparatus 100 includes a liquid storage mechanism 150 including a liquid storage portion 120 that can store the liquid supplied from the liquid supply source 101. The liquid supply apparatus 100 may include the liquid storage mechanisms 150 whose number corresponds to the number of the types of the liquid used by the liquid ejecting system 10, or the liquid storage mechanism 150 including the liquid storage portions 120 whose number corresponds to the number of the types of the liquid used by the liquid ejecting system 10. The liquid storage mechanism 150 may be detachably provided to the liquid supply source holding portion 102. In this case, the liquid storage mechanism 150 may be provided at a position where it is exposed from the liquid supply source holding portion 102 when a cover 103 provided in the liquid supply source holding portion 102 is opened.

As illustrated in FIG. 3A and FIG. 3B, the liquid supply channel 110 of the present embodiment includes a first liquid channel 111 and a second liquid channel 112 serving as supply paths. The first liquid channel 111 couples the liquid supply source 101 and the liquid storage portion 120. The second liquid channel 112 couples the liquid storage portion 120 and the liquid ejecting portion 41. Note that in the illustration of FIG. 3A and FIG. 3B, the configurations of the liquid ejecting system 10 and the liquid supply apparatus 100 are separated at a middle position (A) of the second liquid channel 112.

As illustrated in FIG. 3B, the first liquid channel 111 includes a cylindrical coupling part 113 that is coupled with the liquid outlet portion 502 of the liquid supply source 101 when the liquid supply source 101 is attached to the liquid supply source holding portion 102. In the outer peripheral surface of the coupling part 113, a liquid inflow opening 114 where the liquid of the liquid supply source 101 flows into the coupling part 113 in a coupling state where the liquid outlet portion 502 of the liquid supply source 101 and the coupling part 113 are coupled with each other is provided.

The liquid storage portion 120 provided in the liquid storage mechanism 150 is configured to store liquid. The liquid storage portion 120 is provided in the liquid supply channel 110. The liquid storage portion 120 is located between the liquid supply source 101 and the liquid ejecting portion 41 in the liquid supply channel 110. The liquid storage portion 120 stores the liquid supplied from the liquid supply source 101. Thus, the liquid storage portion 120 is disposed downstream of the liquid supply source 101 in the direction in which the liquid is supplied.

The liquid storage portion 120 may have a configuration in which at least a part of it is formed of a flexible member 121 serving as a flexible part having flexibility such that its volume changes. The liquid storage portion 120 of the present embodiment includes a bag member 122 formed of the flexible member 121 serving as a flexible part having flexibility, and a plate-shaped coupler 123 coupled to the first liquid channel 111 and the second liquid channel 112. The liquid supplied from the liquid supply source 101 is stored in the bag member 122 through the first liquid channel 111 and the coupler 123. The bag member 122 swells and shrinks in accordance with the amount of the liquid stored therein. That is, the volume of the bag member 122 changes as it swells and shrinks.

The liquid storage portion 120 is configured to store the liquid of a predetermined amount or greater while the liquid can be supplied from the liquid supply source 101. The predetermined amount is greater than the amount of liquid of the state where the remaining amount of the liquid of the liquid supply source 101 is small. For example, the predetermined amount is the amount of the liquid that is expected to be required when one image is printed to the maximum printable size. Thus, even in the case where the remaining amount of the liquid of the liquid supply source 101 becomes small during the printing of an image, and it is determined to be ink end, and, replacement of the liquid supply source 101 and/or replenishment of liquid is required, the liquid stored in the liquid storage portion 120 can be supplied to the liquid ejecting portion 41, and the printing of the image can be continued. In this manner, the risk of interrupting the printing is reduced. As a result, the time required for the printing process of the liquid ejecting system 10 can be shortened, and the degradation of the printing quality such as color unevenness due to the interruption of the printing can be suppressed.

In the present embodiment, the liquid storage mechanism 150 generates a negative pressure greater than that of the inside of the liquid housing part 501 of the liquid supply source 101 in the liquid storage portion 120, and thus the liquid is supplied to the liquid storage portion 120 from the liquid supply source 101. In this manner, while the remaining amount of the liquid housed in the liquid supply source 101 is sufficient, the bag member 122 is maintained in a swelled state.

When the negative pressure that is generated in the liquid housing part 501 of the liquid supply source 101 when the remaining amount of the liquid housed in the liquid supply source 101 becomes small is defined as a first negative pressure (for example, −10 kPa in gauge pressure), the liquid storage mechanism 150 generates a second negative pressure (for example, −15 kPa in gauge pressure) larger than the first negative pressure in the liquid storage portion 120 when the storage amount of the liquid in the liquid storage portion 120 becomes smaller than a set predetermined amount.

At least when the remaining amount of the liquid stored in the liquid supply source 101 is small, the bag member 122 of the liquid storage portion 120 is expanded in a set volume or greater to store the liquid of a predetermined amount or greater. Then, when the printing of the image or the like is continued even after the remaining amount of the liquid housed in the liquid supply source 101 has become small, the liquid is supplied from the liquid storage portion 120 to the liquid ejecting portion 41, and the amount of the liquid stored in the liquid storage portion 120 begins to decrease.

To generate the second negative pressure in the liquid storage portion 120, the liquid storage mechanism 150 may include a housing member 152 including a powder housing chamber 151 that houses the liquid storage portion 120, and a pull spring 153 serving as an expansion member that deforms the flexible member 121 in the direction in which the volume in the liquid storage portion 120 is increased. A hook of the pull spring 153 on one side is fixed to a plate-shaped member 154 bonded to the flexible member 121, and a hook of the pull spring 153 on the other side is fixed to an inner wall 151*a* of the powder housing chamber 151 facing the plate-shaped member 154 in such a manner that the volume of the bag member 122 is increased. The coupler 123 fixed to the bag member 122 is fixed to an inner wall 151*b* of the powder housing chamber 151 facing thereto.

The liquid storage mechanism 150 of the present embodiment swells the bag member 122 to increase the volume in the liquid storage portion 120 by pulling the flexible member 121 of the bag member 122 of the liquid storage portion 120 through the use of the pull spring 153. When the bag member 122 swells, the pressure in the liquid storage portion 120 decreases. In this manner, the liquid storage mechanism 150 generates, in the liquid storage portion 120, a negative pressure lower than the atmospheric pressure as the external pressure of the liquid storage portion 120 from the outside of the liquid storage portion 120. Thus, in the present embodiment, when the amount of the liquid stored in the liquid storage portion 120 becomes small, the pressure in the liquid storage portion 120 becomes a third negative pressure (for example, −20 kPa in gauge pressure) larger than the second negative pressure.

The liquid storage mechanism 150 may include a storage amount detection portion 155 that detects the amount of the liquid stored in the liquid storage portion 120. The storage amount detection portion 155 of the present embodiment is a contact detection switch that detects that the amount of the liquid stored in the liquid storage portion 120 has become small by making contact with the flexible member 121 serving as a displacement part that displaces in accordance with the volume of the bag member 122 changes. The storage amount detection portion 155 may be an optical detection sensor that detects displacement of the flexible member 121, or a pressure sensor that detects that the amount of the liquid stored in the liquid storage portion 120 has become small by detecting that the pressure in the liquid storage portion 120 has become the third negative pressure.

The liquid supply apparatus 100 includes a block mechanism 160. The block mechanism 160 blocks the communication between the outside of the coupling part 113 and the liquid storage portion 120 when the liquid supply source 101 and the coupling part 113 are brought into a decoupled state where they are decoupled in a process of detaching the liquid supply source 101 from the liquid supply source holding portion 102, for example.

The block mechanism 160 may include an opening/closing valve 161 in which a communication chamber 162 is provided in the first liquid channel 111 serving as a supply path. The opening/closing valve 161 may include a diaphragm valve 163 including, as a single piece, a valve part and a diaphragm part forming the communication chamber 162. The diaphragm valve 163 is displaced between a closed valve position for setting a closed state that sets the first liquid channel 111 to a non-communication state and an open valve position for setting an open state that sets the first liquid channel 111 to a communication state. The block mechanism 160 blocks the communication between the external space of the coupling part 113 and the liquid storage portion 120 by setting the first liquid channel 111 to the non-communication state. Together with the first liquid channel 111 coupled with the liquid storage mechanism 150, the block mechanism 160 may be detachably provided to the liquid supply source holding portion 102 as a part of the liquid storage mechanism 150.

The opening/closing valve 161 may include a displacement spring 164 that displaces the diaphragm valve 163 from the closed valve position to the open valve position. The force of the displacement spring 164 for displacing the diaphragm valve 163 from the closed valve position to the open valve position may be set to a value with which the diaphragm valve is not brought into the closed state even when the third negative pressure generated in the liquid storage portion 120 acts on the communication chamber 162.

The block mechanism 160 may include, for example, a rod member 165 serving as a movement member that moves from a block release position for setting the opening/closing valve 161 to the open state to a blocking position for setting the opening/closing valve 161 to the closed state in conjunction with the movement of the liquid supply source 101 from the coupling state to the decoupled state in a process of detaching the liquid supply source 101 from the liquid supply source holding portion 102. The rod member 165 may include a contact part 166 capable of making contact with the front surface of the housing case 500 at which a liquid outlet port 505 of the liquid supply source 101 opens, and a pressing part 167 that pushes the diaphragm valve 163 of the opening/closing valve 161 to displace it from the open valve position to the closed valve position.

The block mechanism 160 may include a block spring 168 that pushes the rod member 165 toward the front surface of the housing case 500 of the liquid supply source 101 attached to the liquid supply source holding portion 102. The rod member 165 is pushed by the block spring 168 so as to be movable between the blocking position and the block release position. When the liquid supply source 101 is located at a position corresponding to the decoupled state, the rod member 165 is pushed by the block spring 168 and positioned at the blocking position where the pressing part 167 pushes the diaphragm valve 163 to set the opening/closing valve 161 to the closed state. When the liquid supply source 101 is located at a position corresponding to the coupling state as illustrated in FIG. 3B, the rod member 165 is positioned at the block release position where the pressing part 167 does not make contact with the diaphragm valve 163, with the contact part 166 pushed by the front surface of the housing case 500.

The liquid supply apparatus 100 may include a remaining amount detection mechanism 180 that detects the remaining amount of the liquid housed in the liquid supply source 101. The remaining amount detection mechanism 180 detects displacement of the displacement wall 509 of the liquid pressure detection portion 504 provided in the liquid supply source 101. The remaining amount detection mechanism 180 may include a detection member 181 that moves in conjunction with displacement of the displacement wall 509, a remaining amount detection sensor 182 that detects the position of the detection member 181, and a remaining amount detection spring 183 that pushes the detection member 181 toward the displacement wall 509. The detection member 181 may include an end portion 181*a* that makes contact with the displacement wall 509, and a detection object part 181*b* that is detected by the remaining amount detection sensor 182.

The remaining amount detection sensor 182 includes a light emission part 182*a* that emits light toward the detection object part 181*b*, and a light reception part 182*b* that receives light reflected by the detection object part 181*b*. The detection object part 181*b* is located at a position where it reflects the light emitted from the light emission part 182*a* in accordance with the position of the displacement wall 509 of the case where the remaining amount of the liquid housed in the liquid supply source 101 is sufficient as illustrated in FIG. 3B. At this time, when the light emission part 182*a* emits light, the light reception part 182*b* receives the light reflected by the detection object part 181*b*.

Then, when the remaining amount of the liquid housed in the liquid supply source 101 becomes small, and the displacement wall 509 is displaced in the direction in which the volume in the liquid pressure detection portion 504 is reduced due to the first negative pressure generated in the liquid housing part 501 acting on the liquid pressure detection portion 504, the detection object part 181*b* moves to a position where it does not reflect the light emitted from the light emission part 182*a* in accordance with the displacement of the displacement wall 509. At this time, even when the light emission part 182*a* emits light, the light is not reflected by the detection object part 181*b*, and therefore the light reception part 182*b* does not receive the light.

The remaining amount detection sensor 182 outputs the light reception amount received by the light reception part 182*b* to the control portion 60. The control portion 60 may determine that the remaining amount of the liquid housed in the liquid supply source 101 has become small when the light reception amount received by the light reception part 182*b* is smaller than a set value.

The liquid supply apparatus 100 may include, as a liquid feeding mechanism, a pressing mechanism 170 that feeds liquid toward the liquid ejecting portion 41.

As illustrated in FIG. 3A, the pressing mechanism 170 is provided in the liquid supply channel 110. The pressing mechanism 170 is located between the liquid storage portion 120 and the liquid ejecting portion 41 in the liquid supply channel 110. Therefore, the pressing mechanism 170 of the present embodiment is provided in the second liquid channel 112, and the liquid storage portion 120 is provided between the pressing mechanism 170 serving as a liquid feeding mechanism and the liquid supply source 101 in the liquid supply channel 110. The liquid of the liquid supply source 101 is supplied by the pressing mechanism 170 to the liquid ejecting portion 41 through the liquid storage portion 120.

The pressing mechanism 170 of the present embodiment includes a volume pump 171, a first valve 172 and a second valve 173. The first valve 172 is located upstream of the volume pump 171 in the liquid supply channel 110. The second valve 173 is located downstream of the volume pump 171 in the liquid supply channel 110. The first valve 172 and the second valve 173 of the present embodiment are one-direction valves that allow the flow of the liquid from the upstream side to the downstream side, and restrict the flow of the liquid from the downstream side to the upstream side in the liquid supply channel 110. The first valve 172 and the second valve 173 may be solenoid valves that open and close with a solenoid, or electric valves that open and close the valve with an electric motor.

The volume pump 171 is configured to apply a pressure to the liquid by reciprocating a flexible film 174 having flexibility. The volume pump 171 includes a pump chamber 175 and a negative pressure chamber 176 that are separated from each other with the flexible film 174. The volume pump 171 includes a pressure reduction part 177 for depressurizing the negative pressure chamber 176, and a pressing member 178 that presses the flexible film 174 toward a pump chamber 175 side. The pressing member 178 is provided in the negative pressure chamber 176.

When the pressure reduction part 177 depressurizes the negative pressure chamber 176, the flexible film 174 is displaced to increase the volume of the pump chamber 175. At this time, the liquid is drawn into the pump chamber 175 from the liquid supply source 101 through the liquid storage portion 120. The negative pressure generated in the pump chamber 175 through the depressurization of the negative pressure chamber 176 is set to a value for generating a negative pressure (for example, −40 kPa in gauge pressure) greater than the third negative pressure so that the liquid can be drawn into the liquid storage portion 120 even after the remaining amount of the liquid housed in the liquid supply source 101 has become small.

When the depressurization of the negative pressure chamber 176 using the pressure reduction part 177 is stopped and the inside of the negative pressure chamber 176 is opened to the atmosphere, the flexible film 174 is pressed by the pressing member 178 and displaced to reduce the volume of the pump chamber 175. At this time, the liquid is pushed out from the pump chamber 175. That is, the volume pump 171 of the present embodiment is composed of a diaphragm pump. The volume pump 171 may be composed of a tube pump.

With the pressing member 178 pressing the liquid in the pump chamber 175 through the flexible film 174, the pressing mechanism 170 applies a pressure to the liquid. In this manner, the pressing mechanism 170 supplies the liquid toward the liquid ejecting portion 41. The pressure force of the pressing mechanism 170 applying a pressure to the liquid is set by the pressing force of the pressing member 178.

The liquid supply apparatus 100 may include, as a liquid feeding mechanism, a supply valve 140 capable of opening and closing the liquid supply channel 110. The supply valve 140 is provided in the liquid supply channel 110. The supply valve 140 is located between the pressing mechanism 170 and the liquid ejecting portion 41 in the liquid supply channel 110. Therefore, the supply valve 140 is provided in the second liquid channel 112. When the supply valve 140 opens, the liquid can be supplied from the liquid supply source 101 to the liquid ejecting portion 41. When the supply valve 140 closes, the supply of the liquid from the liquid supply source 101 to the liquid ejecting portion 41 is blocked.

The supply valve 140 may be, for example, a solenoid valve that opens and closes with a solenoid, or an electric valve that opens and closes the valve with an electric motor. The supply valve 140 may be a fluid pressure valve that opens and closes the valve with a hydropneumatic cylinder, or other control valves.

The liquid supply apparatus 100 may be configured to supply liquid from the liquid supply source 101 to the liquid ejecting portion 41 through the use of the head difference, without being provided with the pressing mechanism 170. In this case, the supply valve 140 is provided in the second liquid channel 112 between the liquid storage portion 120 and the liquid ejecting portion 41 in the liquid supply channel 110. When the supply valve 140 opens, the liquid can be supplied from the liquid supply source 101 to the liquid ejecting portion 41. When the supply valve 140 closes, the supply of the liquid from the liquid supply source 101 to the liquid ejecting portion 41 is blocked.

The liquid supply apparatus 100 may include a first filter portion 210, a second filter portion 220, a third filter portion 230, and a liquid pressure adjustment mechanism 280. The first filter portion 210, the second filter portion 220, the third filter portion 230, and the liquid pressure adjustment mechanism 280 are provided in the liquid supply channel 110, and located between the supply valve 140 and the liquid ejecting portion 41. In the present embodiment, from the upstream side, the first filter portion 210, the second filter portion 220, the liquid pressure adjustment mechanism 280, and the third filter portion 230 are provided in this order in the second liquid channel 112.

In the first filter portion 210, the second filter portion 220 and the third filter portion 230, as the operation time increases and the amount of the captured foreign matters increases, the ability to collect foreign matters decreases. Therefore, the liquid ejecting system 10 may be configured such that at least one of the first filter portion 210, the second filter portion 220 and the third filter portion 230 is replaceable. For example, as illustrated in FIG. 2, the first filter portion 210 may be provided at a position where it is exposed from the housing 12 when a cover 18 of the housing 12 is opened.

As illustrated in FIG. 3A, the first filter portion 210 includes a first filter 211 that captures foreign matters, a first upstream filter chamber 212 located upstream of the first filter 211, and a first downstream filter chamber 213 located downstream of the first filter 211. The first upstream filter chamber 212 is located below the first downstream filter chamber 213. The first upstream filter chamber 212 is provided in a substantially cone shape or a substantially truncated cone shape. The first filter 211 is formed in a substantially disk-like shape to form the bottom surface of the first upstream filter chamber 212. The height of the first upstream filter chamber 212 may be smaller than the diameter of the first filter 211.

The second filter portion 220 includes a second filter 221 that captures foreign matters, a second upstream filter chamber 222 located upstream of the second filter 221, and a second downstream filter chamber 223 located downstream of the second filter 221.

The third filter portion 230 includes a third filter 231 that captures foreign matters, a third upstream filter chamber 232 located upstream of the third filter 231, and a third downstream filter chamber 233 located downstream of the third filter 231.

The first filter 211, the second filter 221 and the third filter 231 may be formed such that the filtration area through which liquid can pass through is greater than the channel cross-sectional area of the liquid supply channel 110. For example, mesh members, porous members, porous plates in which minute through holes are formed or the like may be used as the first filter 211, the second filter 221 and the third filter 231. The first filter 211, the second filter 221 and the third filter 231 may be filters of different types and different shapes.

The liquid pressure adjustment mechanism 280 of the present embodiment is provided integrally with the second filter portion 220 at a position downstream of the second filter portion 220. The liquid pressure adjustment mechanism 280 includes a liquid chamber 282 communicated with the second downstream filter chamber 223 through a communication hole 281, and a valve element 283 capable of opening and closing the communication hole 281. The liquid pressure adjustment mechanism 280 includes a pressure reception member 284 having a base end housed in the second downstream filter chamber 223 and a top end housed in the liquid chamber 282.

The liquid chamber 282 of the liquid pressure adjustment mechanism 280 can store liquid. A part of the wall surface of the liquid chamber 282 is formed of a deflectable and displaceable flexible wall 285. It suffices that the valve element 283 is an elastic body of rubber or resin attached at the base end portion of the pressure reception member 284 located in the second downstream filter chamber 223, for example.

The liquid pressure adjustment mechanism 280 includes a second pressing member 286 housed in the second downstream filter chamber 223, and a third pressing member 287 housed in the liquid chamber 282. The second pressing member 286 presses the valve element 283 in a direction of closing the communication hole 281 through the pressure reception member 284. When the flexible wall 285 is deflected and displaced in a direction of reducing the volume of the liquid chamber 282 and the flexible wall 285 pushes the pressure reception member 284, the third pressing member 287 pushes back the pressure reception member 284.

When the pushing force of the flexible wall 285 against the pressure reception member 284 becomes greater than the pressing force of the second pressing member 286 and the third pressing member 287 due to a reduction in the inner pressure of the liquid chamber 282, the valve element 283 opens the communication hole 281. When the communication hole 281 opens and the liquid flows into the liquid chamber 282 from the second downstream filter chamber 223, the inner pressure of the liquid chamber 282 increases. As a result, before the inner pressure of the liquid chamber 282 is increased to a positive pressure, the valve element 283 closes the communication hole 281 with the pressing force of the second pressing member 286 and the third pressing member 287. In this manner, the inner pressure of the liquid chamber 282 is maintained in a negative pressure range (for example, −0.5 kPa to −1.5 kPa in gauge pressure) corresponding to the pressing force of the second pressing member 286 and the third pressing member 287.

The inner pressure of the liquid chamber 282 decreases as the liquid is ejected from the liquid ejecting portion 41. The valve element 283 autonomously opens and closes the communication hole 281 in accordance with the pressure difference between the atmospheric pressure as the external pressure of the liquid chamber 282 and the inner pressure of the liquid chamber 282. As such, the liquid pressure adjustment mechanism 280 is a pressure difference valve. The pressure difference valve is also called a pressure reducing valve or a self-sealing valve.

The liquid ejecting system 10 may include an ejection mechanism 50 configured to depressurize the liquid supply channel 110 through the liquid ejecting portion 41. The ejection mechanism 50 is configured to eject the liquid in the liquid supply channel 110 from the liquid ejecting portion 41 by depressurizing the liquid supply channel 110 through the liquid ejecting portion 41.

The ejection mechanism 50 of the present embodiment includes a cap 51 capable of covering the nozzle 44 of the liquid ejecting portion 41, and a suction pump 52 that suctions the inside of the cap 51. The cap 51 makes contact with the liquid ejecting portion 41 for the purpose of capping the liquid ejecting portion 41. Capping refers to formation of a space to which the nozzle 44 opens. Capping is performed to suppress drying of the nozzle 44 and the like.

When the suction pump 52 is driven with the cap 51 capping the liquid ejecting portion 41, a negative pressure acts on the nozzle 44 and liquid is forcibly ejected from the nozzle 44. This operation refers to suction cleaning. That is, the ejection mechanism 50 of the present embodiment ejects the liquid in the liquid supply channel 110 from the liquid ejecting portion 41 by depressurizing the liquid supply channel 110 through the liquid ejecting portion 41.

When the suction cleaning is performed, bubbles, foreign matters and the like in the liquid ejecting portion 41 and the liquid supply channel 110 are ejected together with the liquid. As such, the ejection mechanism 50 depressurizes the liquid supply channel 110 to perform maintenance of the liquid ejecting system 10.

The ejection mechanism 50 may include a liquid waste tank 53 for collecting the liquid waste ejected from the liquid ejecting portion 41. In this manner, the liquid waste ejected to the cap 51 by suction cleaning can be collected by the liquid waste tank 53, for example. The liquid waste tank 53 may directly collect the ejected liquid waste, or may collect the liquid waste to a suction member provided in the liquid waste tank 53.

The ejection mechanism 50 may include a regulator 54 that adjusts the pressure in the cap 51. The regulator 54 adjusts the pressure in the cap 51 to a predetermined pressure by communicating between the inside of the cap 51 and the atmosphere such that the pressure in the cap 51 is set to the predetermined pressure during the capping. The regulator 54 may be an atmosphere open valve that closes to exert a negative pressure on the nozzle 44, and opens to communicate the inside of the cap 51 with the atmosphere.

The liquid ejecting system 10 is configured to execute a maintenance operation of depressurizing the liquid supply channel 110 using the ejection mechanism 50 in the state where the liquid supply channel 110 is closed by the supply valve 140. When the liquid supply channel 110 is depressurized by the ejection mechanism 50 in the state where the liquid supply channel 110 is closed by the supply valve 140, a negative pressure (for example, −80 kPa in gauge pressure) is accumulated in a portion downstream of the supply valve 140 in the liquid supply channel 110. When a negative pressure is accumulated in the liquid supply channel 110, the volume of the bubbles in the liquid supply channel 110 increases. This increases the ease of ejection of the bubbles in the liquid supply channel 110.

In the present embodiment, the liquid is ejected from the nozzle 44 by opening the supply valve 140 in the state where a negative pressure is accumulated in the liquid supply channel 110. An operation of accumulating a negative pressure generated through depressurization of the liquid supply channel 110 by the ejection mechanism 50 and vigorously ejecting the liquid in the liquid supply channel 110 from the nozzle 44 using the accumulated negative pressure in the above-described manner is commonly called choke cleaning. Choke cleaning is executed for maintenance of the liquid ejecting system 10. When choke cleaning is executed, bubbles, foreign matters and the like in the liquid ejecting portion 41 and the liquid supply channel 110 are ejected together with the liquid. As such, choke cleaning may be executed in an initial filling operation of filling the liquid ejecting portion 41, the first filter portion 210, the second filter portion 220, the third filter portion 230, and the liquid pressure adjustment mechanism 280 having the liquid storage space, with liquid.

When executing the choke cleaning, the liquid ejecting system 10 of the present embodiment closes the supply valve 140 first. Next, the liquid supply channel 110 is depressurized by the ejection mechanism 50 through the liquid ejecting portion 41. In this manner, a negative pressure is accumulated in a portion closer to the liquid ejecting portion 41 than the supply valve 140 in the liquid supply channel 110, or in other words, a portion downstream of the supply valve 140 in the liquid supply channel 110. Next, the supply valve 140 is opened. As a result, the liquid is vigorously ejected from the nozzle 44 through depressurization of the ejection mechanism 50.

For example, in the case where the liquid storage portion 120 is located downstream of the supply valve 140 in the liquid supply channel 110, the negative pressure accumulated in the liquid supply channel 110 may act in the liquid storage portion 120 of the liquid storage mechanism 150 due to the depressurization of the ejection mechanism 50 in choke cleaning, and the liquid may flow out from the liquid storage portion 120. In particular, when the negative pressure accumulated in the liquid supply channel 110 acts in the liquid storage portion 120 in the case where the liquid storage portion 120 is formed of the flexible member 121, the flexible member 121 serving as a displacement part displaces in such a manner that the volume of the liquid storage portion 120 decreases. In this case, as the flexible member 121 displaces, most of the liquid in the liquid storage portion 120 flows out, thus being ejected from the nozzle 44.

The liquid storage portion 120 of the present embodiment is located upstream of the supply valve 140 serving as a liquid feeding mechanism in the liquid supply channel 110. As a result, the negative pressure accumulated in the liquid supply channel 110 due to the depressurization of the ejection mechanism 50 does not act in the liquid storage portion 120 in choke cleaning, which reduces the risk of the outflow of the liquid from the liquid storage portion 120 due to the depressurization of the ejection mechanism 50 in the maintenance operation.

Next, an example of a storage portion filling operation of filling the liquid storage portion 120 of the liquid storage mechanism 150 with liquid is described.

Figure 4:
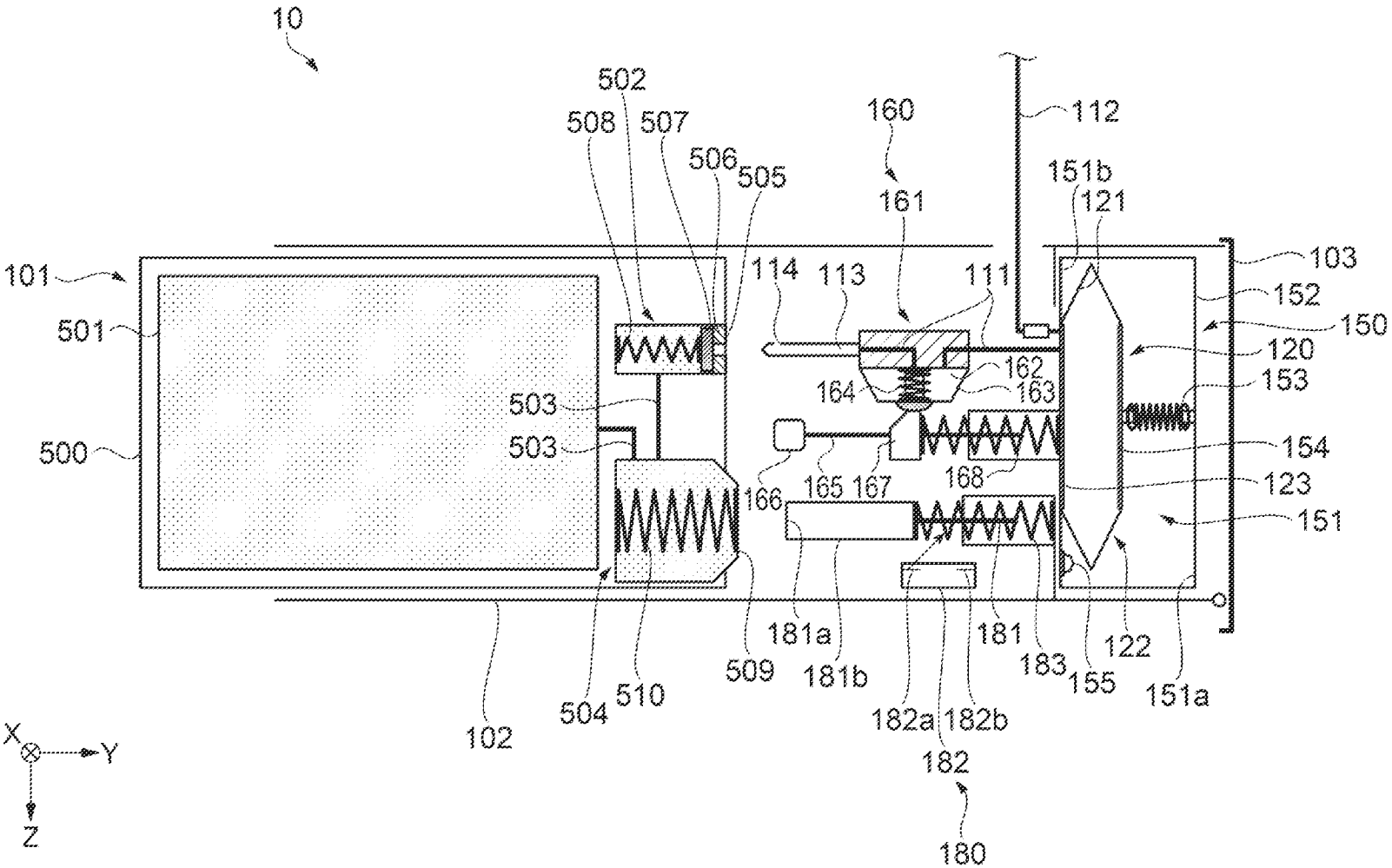
FIG. 4 is a schematic sectional view illustrating a state of air in a liquid storage portion in the embodiment 1.

FIG. 4 illustrates a state where the liquid supply source 101 is located at a position corresponding to the decoupled state. At this time, the rod member 165 of the block mechanism 160 is pushed by the block spring 168 and is located at the blocking position where the pressing part 167 pushes the diaphragm valve 163 and sets the opening/closing valve 161 to the closed state. In addition, the detection member 181 of the remaining amount detection mechanism 180 is pushed by the remaining amount detection spring 183 and is located at a position where the detection object part 181*b* does not reflect the light emitted from the light emission part 182*a* of the remaining amount detection sensor 182. As illustrated in FIG. 4, before the storage portion filling operation is executed, the bag member 122 of the liquid storage portion 120 is filled with air and swelled. In view of this, in the state where the liquid supply source 101 is detached from the liquid supply source holding portion 102, or in the decoupled state as illustrated in FIG. 4, the suction cleaning is executed with the supply valve 140 opened. In this case, the supply valve 140 is open and the diaphragm valve 163 of the block mechanism 160 is in the closed state, and therefore the air in the bag member 122 is suctioned.

Figure 5:
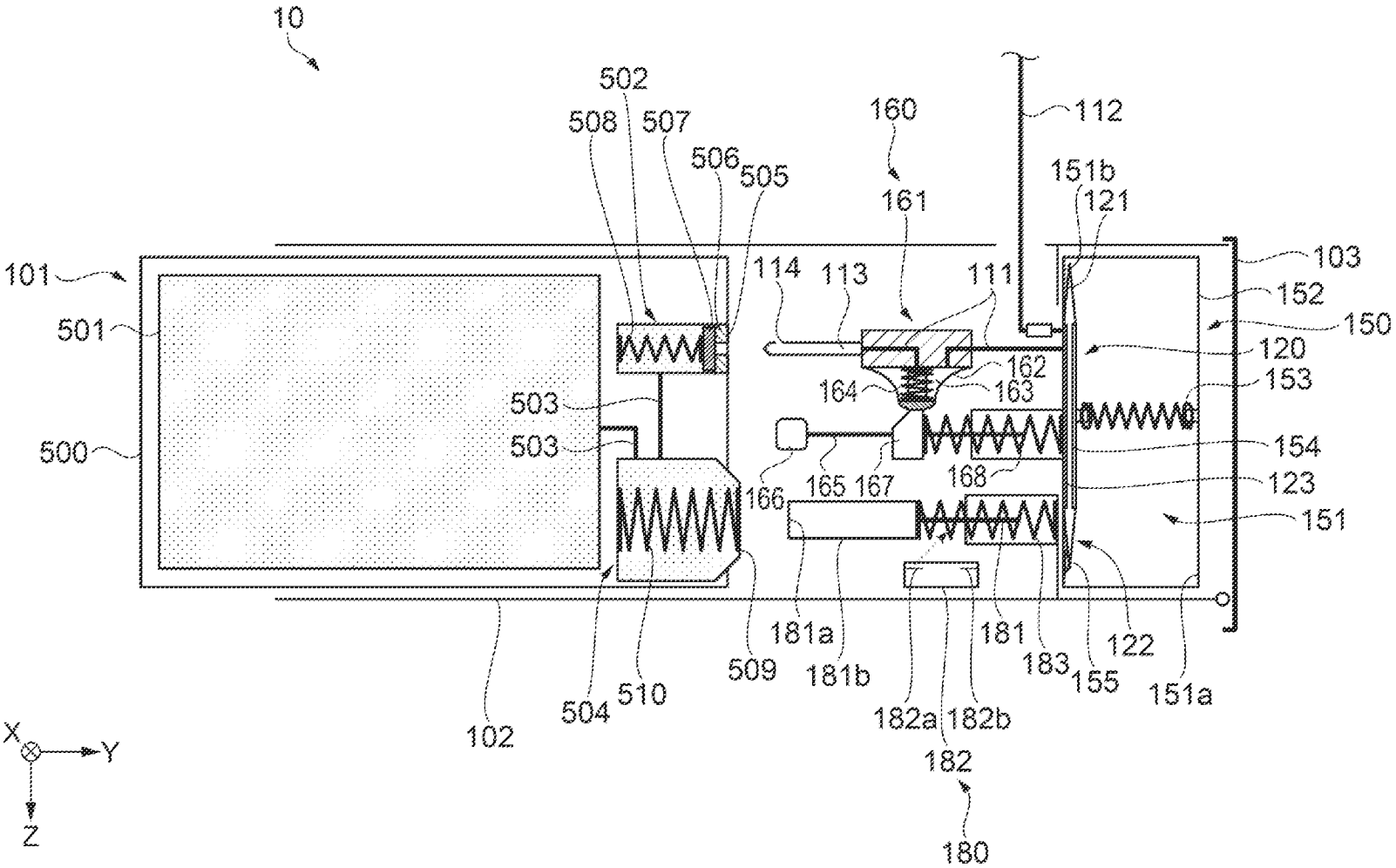
FIG. 5 is a schematic sectional view illustrating a state where the air in the liquid storage portion is ejected in the embodiment 1.
Figure 6:
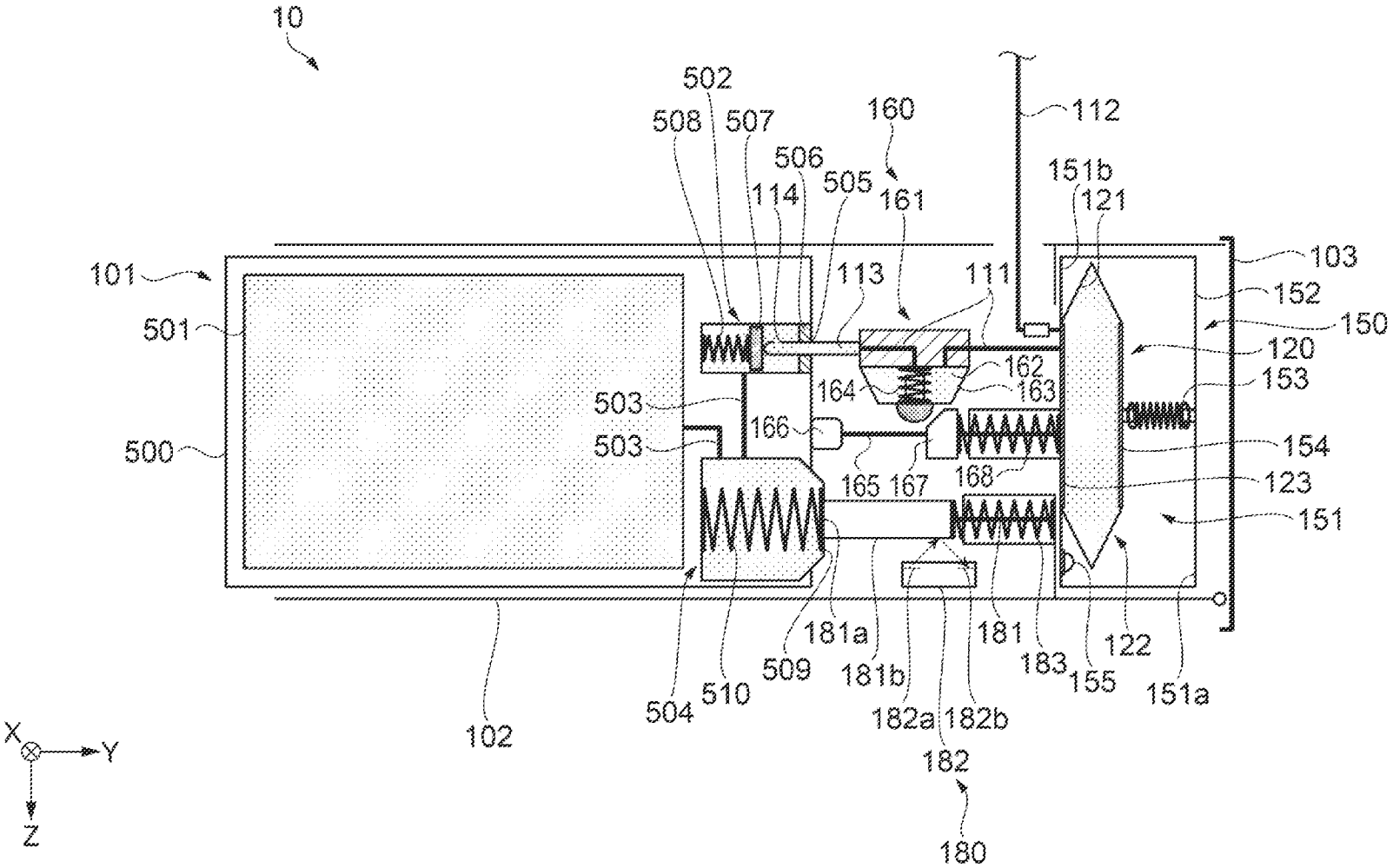
FIG. 6 is a schematic sectional view illustrating a state where the inside of the liquid storage portion is filled with a predetermined amount of liquid in the embodiment 1.

The depressurization of the ejection mechanism 50 is stopped when the air in the bag member 122 of the liquid storage portion 120 is ejected as illustrated in FIG. 5. Then, when the liquid supply source 101 with a sufficient remaining amount of the housed liquid is mounted at a position corresponding to the coupling state as illustrated in FIG. 6, the rod member 165 moves to the block release position, and the diaphragm valve 163 is set to the open state. Since a negative pressure higher than at least the first negative pressure is acting in the liquid supply channel 110, the liquid in the liquid supply source 101 flows into the liquid supply channel 110. The liquid storage portion 120 is expanded to a set volume or greater through the operation of the pull spring 153, and the liquid of a predetermined amount or greater is stored therein. Note that in the state illustrated in FIG. 6, the detection member 181 of the remaining amount detection mechanism 180 is located at a position where the detection object part 181*b* reflects the light emitted from the light emission part 182*a* of the remaining amount detection sensor 182 in accordance with the position of the displacement wall 509 when the remaining amount of the liquid housed in the liquid supply source 101 is sufficient.

When subsequently filling the liquid ejecting portion 41 and the liquid supply channel 110 with the liquid, the suction cleaning including the choke cleaning may be executed by restarting the depressurization of the ejection mechanism 50. In addition, in the case where the storage portion filling operation of filling the liquid storage portion 120 with the liquid is executed in the initial filling operation of filling the liquid ejecting portion 41 and the liquid supply channel 110 with the liquid, the liquid supply source 101 may be set to the coupling state in the state where the depressurization of the ejection mechanism 50 is continued even after the air in the bag member 122 of the liquid storage portion 120 has been ejected.

Next, an operation of the liquid supply apparatus 100 along with the liquid consumption of the printing portion 40 is described.

When the liquid is consumed through the printing of images at the printing portion 40 and the like and the remaining amount of the liquid housed in the liquid housing part 501 of the liquid supply source 101 decreases, a negative pressure is generated in the liquid housing part 501. Then, when the negative pressure generated in the liquid housing part 501 acts on the liquid pressure detection portion 504, the displacement wall 509 is displaced in the direction in which the volume in the liquid pressure detection portion 504 is reduced, and the detection member 181 of the remaining amount detection mechanism 180 also moves in accordance with the displacement of the displacement wall 509.

Figure 7:
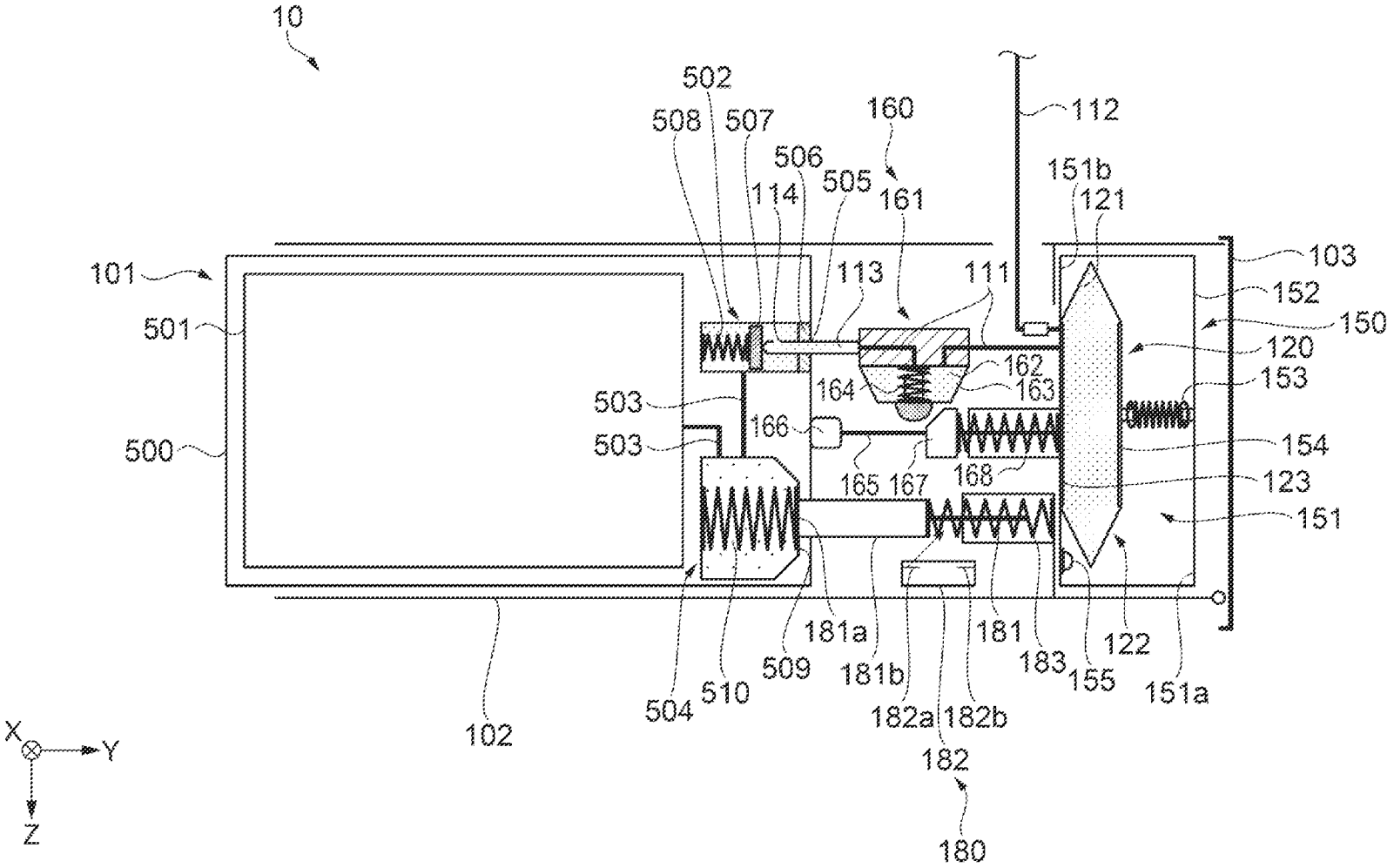
FIG. 7 is a schematic sectional view illustrating a state where the remaining amount of liquid in a liquid supply source has become small in the embodiment 1.

Further, when the remaining amount of the liquid housed in the liquid housing part 501 is reduced to a small amount and the first negative pressure generated in the liquid housing part 501 acts on the liquid pressure detection portion 504, the detection object part 181*b* of the detection member 181 moves from the position where it reflects the light emitted from the light emission part 182*a* to a position where it does not reflect the light emitted from the light emission part 182*a* in accordance with the displacement of the displacement wall 509 as illustrated in FIG. 7. The control portion 60 determines that the remaining amount of the liquid housed in the liquid supply source 101 has become small on the basis of the light reception amount received by the light reception part 182*b* output from the remaining amount detection sensor 182.

Figure 8:
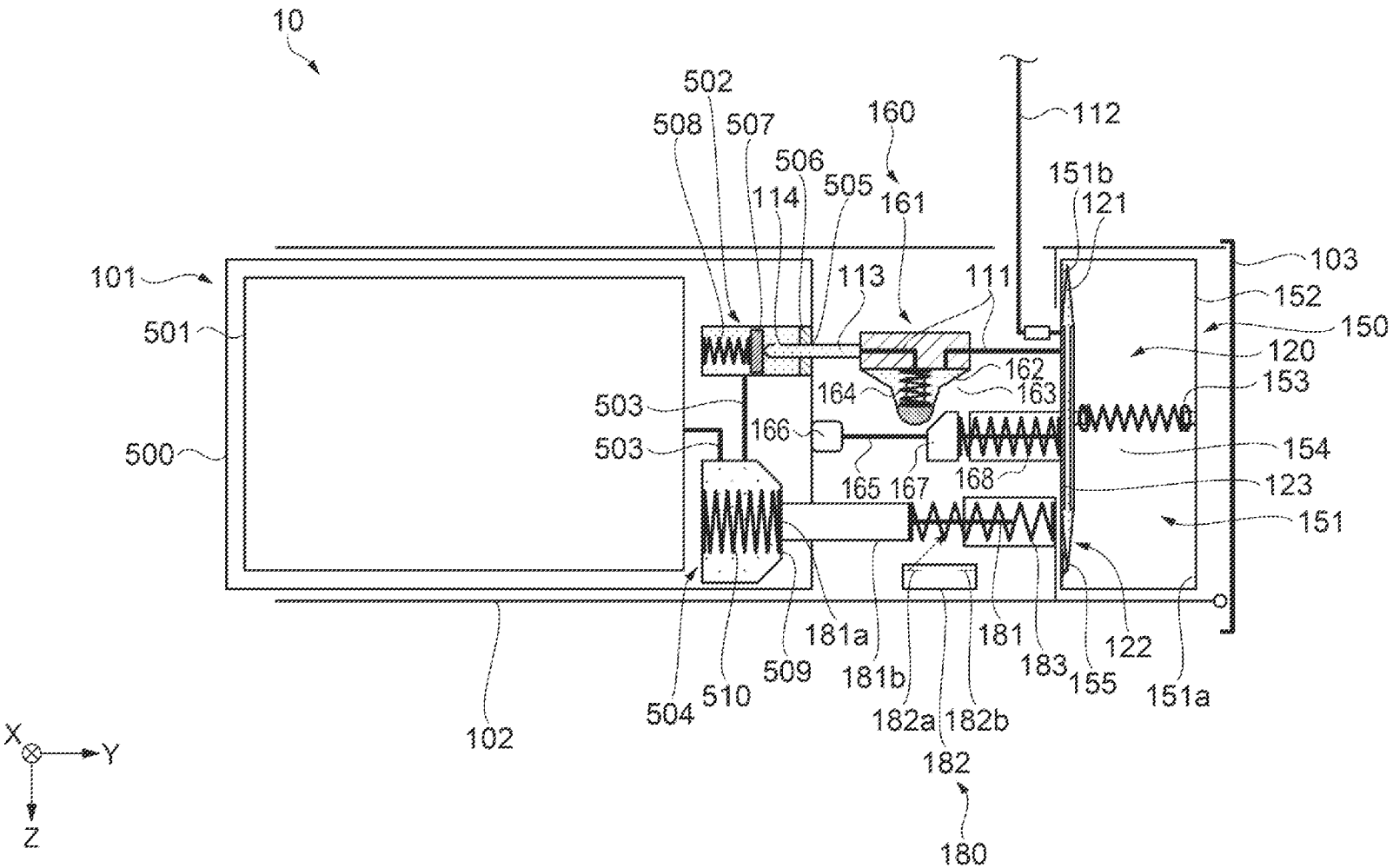
FIG. 8 is a schematic sectional view illustrating a state where the storage amount of the liquid in the liquid storage portion has become small in the embodiment 1.

Then, when the printing of the image or the like is continued even after the remaining amount of the liquid housed in the liquid supply source 101 has become small, the liquid is supplied from the liquid storage portion 120 to the liquid ejecting portion 41, and the amount of the liquid stored in the liquid storage portion 120 decreases. As illustrated in FIG. 8, when the amount of the liquid stored in the liquid storage portion 120 becomes small, the storage amount detection portion 155 detects the flexible member 121 of the liquid storage portion 120. As illustrated in FIG. 8, when the amount of the liquid stored in the liquid storage portion 120 becomes small, the storage amount detection portion 155 detects the flexible member 121 of the liquid storage portion 120.

Figure 9:
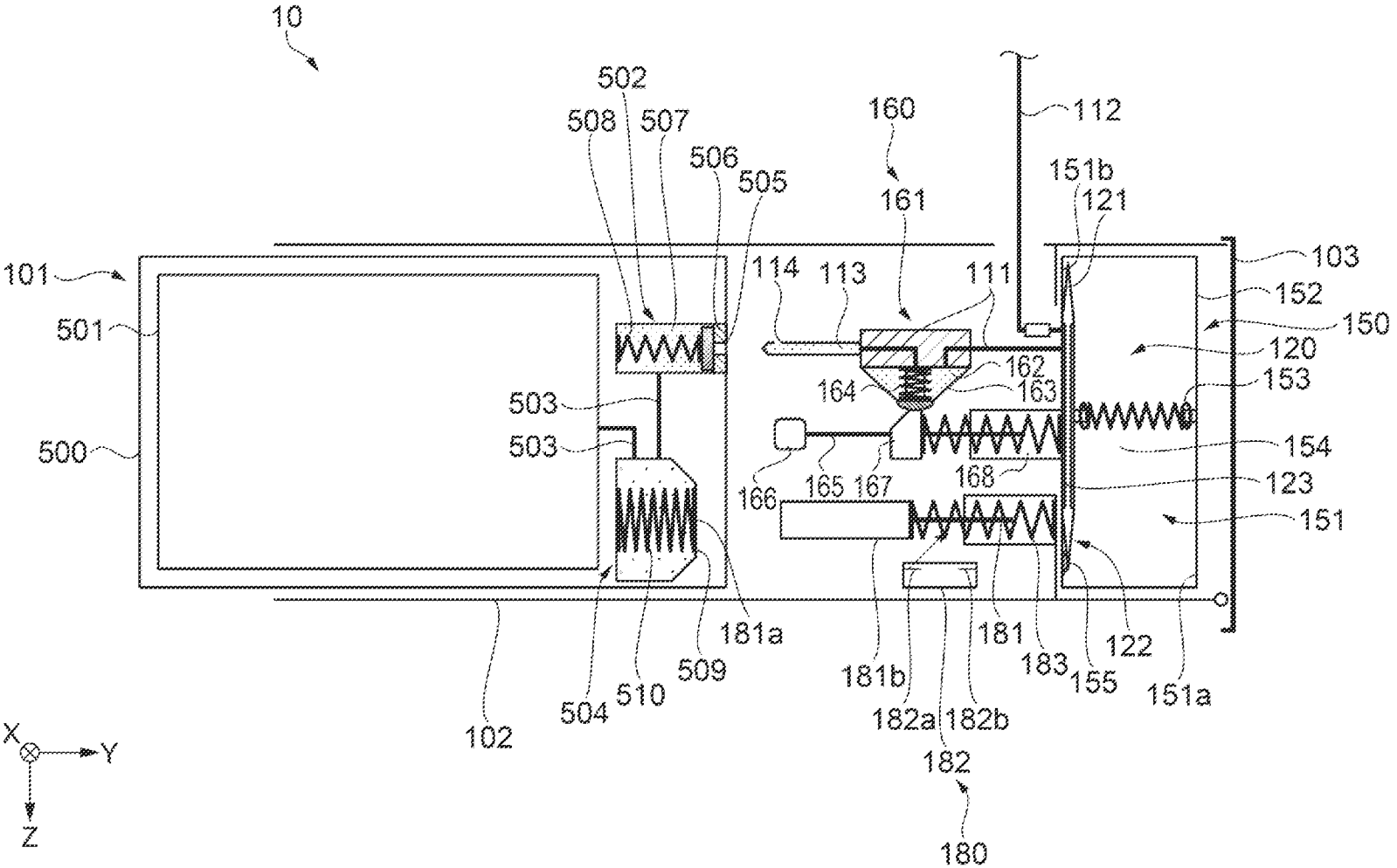
FIG. 9 is a schematic sectional view illustrating a decoupled state of the liquid supply source in the embodiment 1.

As illustrated in FIG. 9, when the liquid supply source 101 is detached from the liquid supply source holding portion 102, the rod member 165 of the block mechanism 160 moves from the block release position for setting the opening/closing valve 161 to the open state to the blocking position for setting the opening/closing valve 161 to the closed state in conjunction with the movement of the liquid supply source 101 from the coupling state to the decoupled state. Thus, even when the inside of the liquid storage portion 120 is set to the third negative pressure, inflow of the air into the liquid storage portion 120 from the outside of the coupling part 113 can be reduced.

As described above, the liquid ejecting system 10 and the liquid storage mechanism 150 according to the embodiment 1 can achieve the following effects.

The liquid ejecting system 10 includes the liquid storage mechanism 150 including the liquid storage portion 120 provided in the liquid supply channel 110 capable of supplying the liquid in the liquid supply source 101 to the liquid ejecting portion 41, and the liquid storage mechanism 150 generates the second negative pressure larger than the first negative pressure inside the liquid storage portion 120 when the storage amount of the liquid of the liquid storage portion 120 becomes smaller than the set predetermined amount, the first negative pressure being a negative pressure that is generated in the liquid supply source 101 when the remaining amount of the liquid in the liquid supply source 101 becomes small. In this manner, even when the remaining amount of the liquid in the liquid supply source 101 becomes small while the liquid ejecting portion 41 is ejecting the liquid, the liquid of a predetermined amount stored in the liquid storage portion 120 can be supplied to the liquid ejecting portion 41, and thus the ejecting of the liquid by the liquid ejecting portion 41 can be continued. For example, even when the remaining amount of the liquid of the liquid supply source 101 becomes small during the printing of an image and replacement of the liquid supply source 101 and/or replenishment of liquid becomes necessary, the printing of the image can be continued. In this manner, the risk of interrupting the printing is reduced.

The liquid storage mechanism 150 includes the pull spring 153 serving as an expansion member that deforms the flexible member 121 serving as a flexible part in the direction in which the volume in the liquid storage portion 120 is increased. In this manner, the second negative pressure can be generated by the pull spring 153 in the liquid storage portion 120.

The liquid ejecting system 10 includes the coupling part 113 that is coupled with the liquid supply source 101 to achieve communication between the liquid supply source 101 and the liquid storage portion 120, and the block mechanism 160 that blocks the communication between the outside of the coupling part 113 and the liquid storage portion 120 when the decoupled state is achieved where the coupling state between the liquid supply source 101 and the coupling part 113 is released. In this manner, even when the inside of the liquid storage portion 120 is set to a negative pressure, inflow of the air into the liquid storage portion 120 from the outside of the coupling part 113 can be reduced.

The block mechanism 160 includes the opening/closing valve 161 and the rod member 165. The opening/closing valve 161, which is provided between the coupling part 113 and the liquid storage portion 120 in the first liquid channel 111, can be set to the open state where the outside of the coupling part 113 and the liquid storage portion 120 are in communication and to the closed state where the outside of the coupling part 113 and the liquid storage portion 120 are not in communication. The rod member 165 serves as a movement member that moves from the block release position for setting the opening/closing valve 161 to the open state to the blocking position for setting the opening/closing valve 161 to the closed state in conjunction with the movement of the liquid supply source 101 from the coupling state to the decoupled state. In this manner, the block mechanism 160 can block the communication between the external space of the coupling part 113 and the liquid storage portion 120 by setting the first liquid channel 111 to the non-communication state.

2. Embodiment 2

Figure 10:
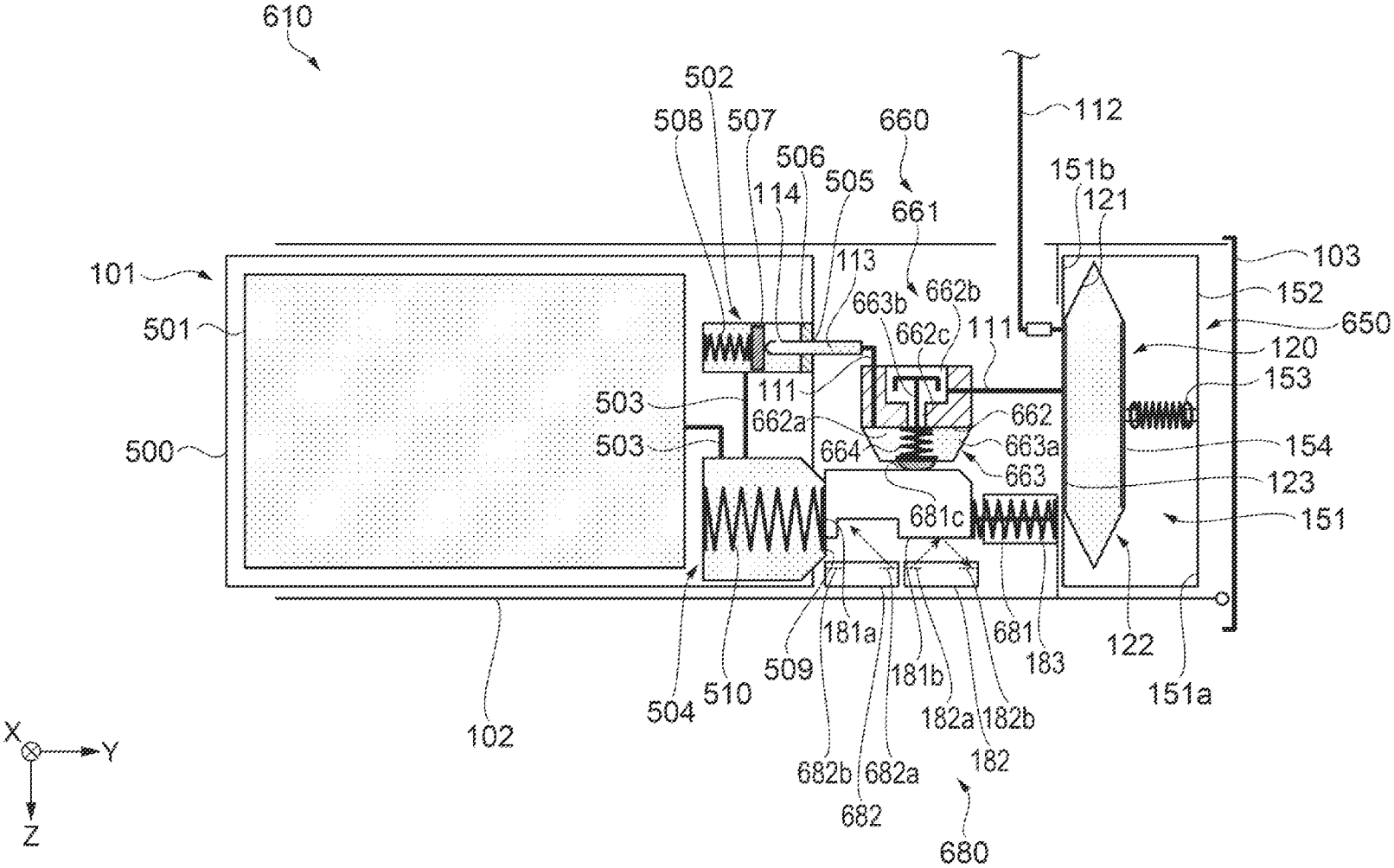
FIG. 10 is a schematic sectional view illustrating a liquid supply source holding portion of a liquid ejecting system according to an embodiment 2.
Figure 11:
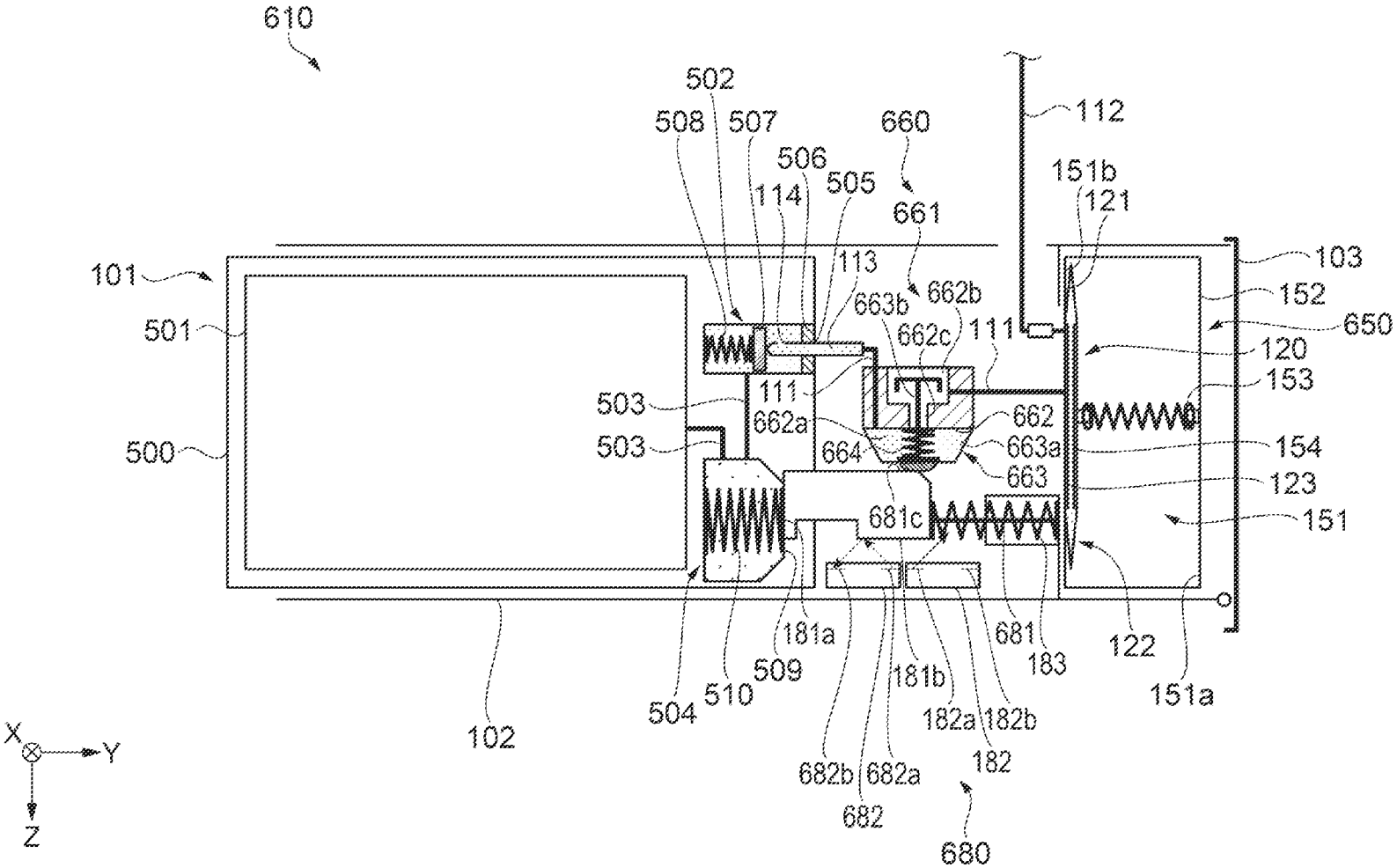
FIG. 11 is a schematic sectional view illustrating a state where the storage amount of liquid in a liquid storage portion has become small in the embodiment 2.

FIG. 10 is a schematic sectional view illustrating a liquid supply source holding portion of a liquid ejecting system according to an embodiment 2, and FIG. 11 is a schematic sectional view illustrating a state where the storage amount of liquid in a liquid storage portion according to the embodiment 2 has become small. A liquid ejecting system 610 is obtained by replacing the block mechanism 160 and the remaining amount detection mechanism 180 of the embodiment 1 with a block mechanism 660 and a remaining amount detection mechanism 680 illustrated in FIG. 10. A liquid storage mechanism 650 is obtained by removing the storage amount detection portion 155 from the liquid storage mechanism 150. Note that the components having the same configurations as those of the embodiment 1 are denoted by the same reference numerals, and overlapping descriptions will be omitted.

As illustrated in FIG. 10, the block mechanism 660 includes an opening/closing valve 661 provided with a communication chamber 662 in the first liquid channel 111 serving as a supply path. The communication chamber 662 is composed of a first communication chamber 662*a* coupled with the coupling part 113 side of the first liquid channel 111, a second communication chamber 662*b* coupled with the liquid storage portion 120 side of the first liquid channel 111, and a communication path 662*c* that communicates between the first communication chamber 662*a* and the second communication chamber 662*b*.

The opening/closing valve 661 may include a diaphragm valve 663 that forms the first communication chamber 662*a*. The diaphragm valve 663 is composed of a diaphragm 663*a* that forms the first communication chamber 662*a*, and a communication valve 663*b* that opens and closes the second communication chamber 662*b* side of the communication path 662*c* in conjunction with the displacement of the diaphragm 663*a*. The opening/closing valve 661 may include a displacement spring 664 that displaces the diaphragm valve 663 from the open valve position to the closed valve position.

The diaphragm valve 663 displaces between the closed valve position for setting the closed state that sets the first liquid channel 111 to the non-communication state and the open valve position for setting the open state that sets the first liquid channel 111 to the communication state. The block mechanism 660 blocks the communication between the external space of the coupling part 113 and the liquid storage portion 120 by setting the first liquid channel 111 to the non-communication state. Together with the first liquid channel 111 coupled with the liquid storage mechanism 650, the block mechanism 660 may be detachably provided to the liquid supply source holding portion 102 as a part of the liquid storage mechanism 650.

As illustrated in FIG. 10, the remaining amount detection mechanism 680 detects the displacement of the displacement wall 509 of the liquid pressure detection portion 504 provided in the liquid supply source 101. The remaining amount detection mechanism 680 may include a detection member 681 that moves in conjunction with the displacement of the displacement wall 509, the remaining amount detection sensor 182 and a second remaining amount detection sensor 682 that detect the position of a detection member 681, and the remaining amount detection spring 183 that pushes the detection member 681 toward the displacement wall 509. The detection member 681 may include the end portion 181*a* that makes contact with the displacement wall 509, the detection object part 181*b* that is detected by the remaining amount detection sensor 182 and the second remaining amount detection sensor 682, and a pressing part 681*c* the that sets opening/closing valve 661 to the open state from the closed state by pushing the diaphragm valve 663 of the opening/closing valve 661.

The pressing part 681*c* of the detection member 681 moves from the block release position for setting the opening/closing valve 661 to the open state to the blocking position for setting the opening/closing valve 661 to the closed state when the detection member 681 moves in conjunction with the movement of the liquid supply source 101 from the coupling state to the decoupled state in a process of detaching the liquid supply source 101 from the liquid supply source holding portion 102. When the liquid supply source 101 is located at a position corresponding to the decoupled state, the detection member 681 is pushed by the remaining amount detection spring 183 and positioned at the blocking position as in the embodiment 1. As illustrated in FIG. 10 and FIG. 11, when the liquid supply source 101 is located at a position corresponding to the coupling state, the detection member 681 is positioned at the block release position with the end portion 181*a* pushed by the displacement wall 509.

The second remaining amount detection sensor 682 includes a light emission part 682*a* that emits light to the detection object part 181*b*, and a light reception part 682*b* that receives the light reflected by the detection object part 181*b*. Until the remaining amount of the liquid housed in the liquid supply source 101 becomes small and the amount of the liquid stored in the liquid storage portion 120 becomes small, the detection object part 181*b* is not located at the position for reflecting the light emitted from the light emission part 682*a* in accordance with the position of the displacement wall 509. At this time, even when the light emission part 682*a* emits light, the light reception part 682*b* does not receive the light reflected by the detection object part 181*b*.

As illustrated in FIG. 11, when the amount of the liquid stored in the liquid storage portion 120 becomes small, the third negative pressure generated in the liquid storage portion 120 acts on the liquid pressure detection portion 504 through the first liquid channel 111. Then, when the displacement wall 509 deforms further than when the remaining amount of the liquid housed in the liquid supply source 101 has become small in the direction in which the volume in the liquid pressure detection portion 504 is reduced, the detection object part 181*b* moves to a position for reflecting the light emitted from the light emission part 682*a* in accordance with the displacement of the displacement wall 509. At this time, when the light emission part 682*a* emits light, the light reception part 682*b* receives the light reflected by the detection object part 181*b*.

The second remaining amount detection sensor 682 outputs, to the control portion 60, the light reception amount received by the light reception part 682*b*. The control portion 60 may determine that the amount of the liquid stored in the liquid storage portion 120 has become small when the light reception amount received by the light reception part 682*b* is greater than the set value.

As described above, the liquid ejecting system 610 and the liquid storage mechanism 650 according to the embodiment 2 can achieve the following effects.

The detection member 681 provided in the remaining amount detection mechanism 680 includes the pressing part 681*c* that brings the opening/closing valve 661 into the open state from the closed state by pushing the diaphragm valve 663 of the opening/closing valve 661 provided in the block mechanism 660. Thus, since the detection member 681 can be applied as the movement member that moves from the block release position for setting the opening/closing valve 661 to the open state to the blocking position for setting the opening/closing valve 661 to the closed state, it is not necessary to additionally provide a movement member to the block mechanism 660.

The second remaining amount detection sensor 682 provided in the remaining amount detection mechanism 680 detects that the amount of the liquid stored in the liquid storage portion 120 has become small. In this manner, the storage amount detection portion 155 may not be provided to the liquid storage mechanism 650.

3. Embodiment 3

Figure 12:
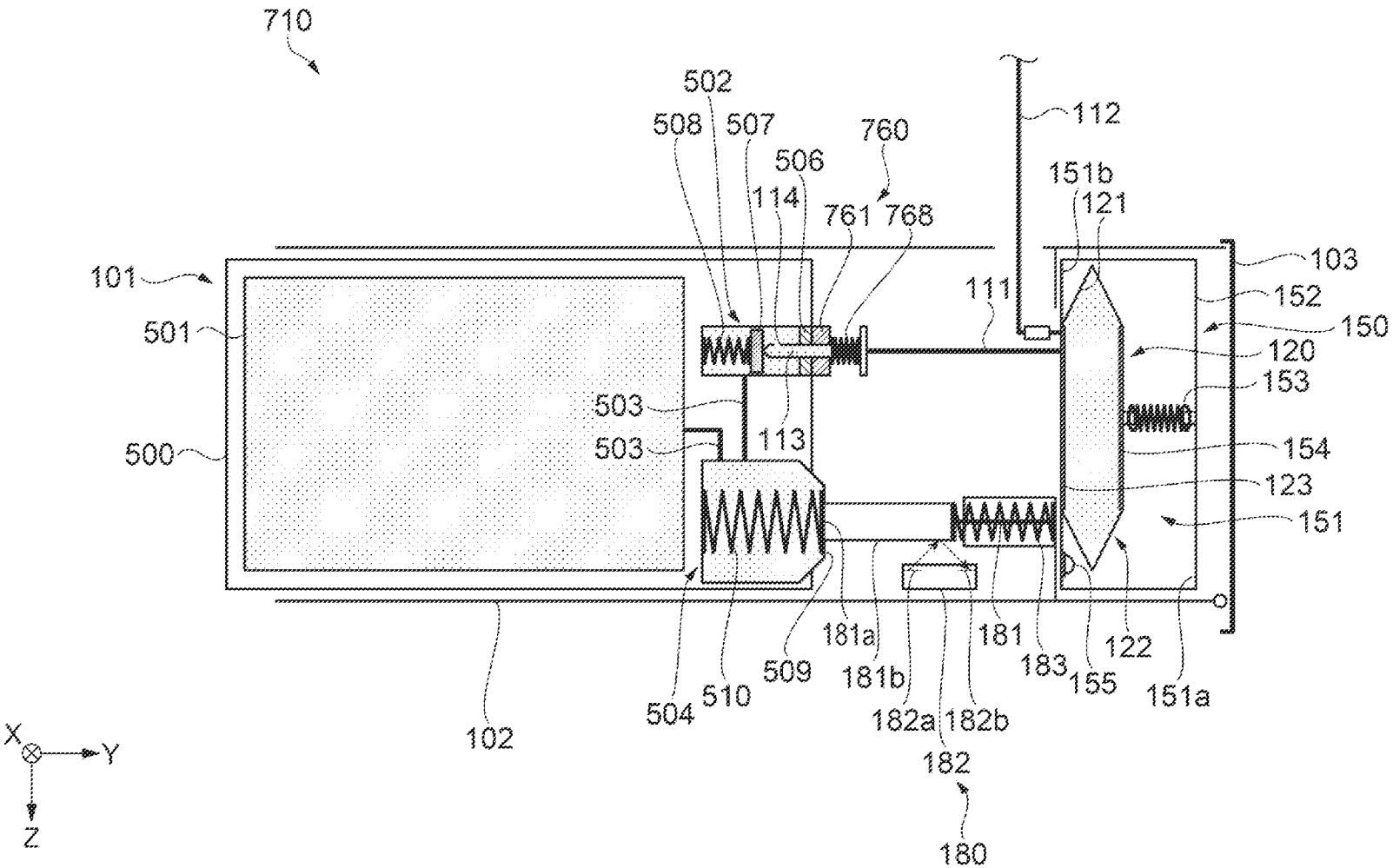
FIG. 12 is a schematic sectional view illustrating a liquid supply source holding portion of a liquid ejecting system according to an embodiment 3.
Figure 13:
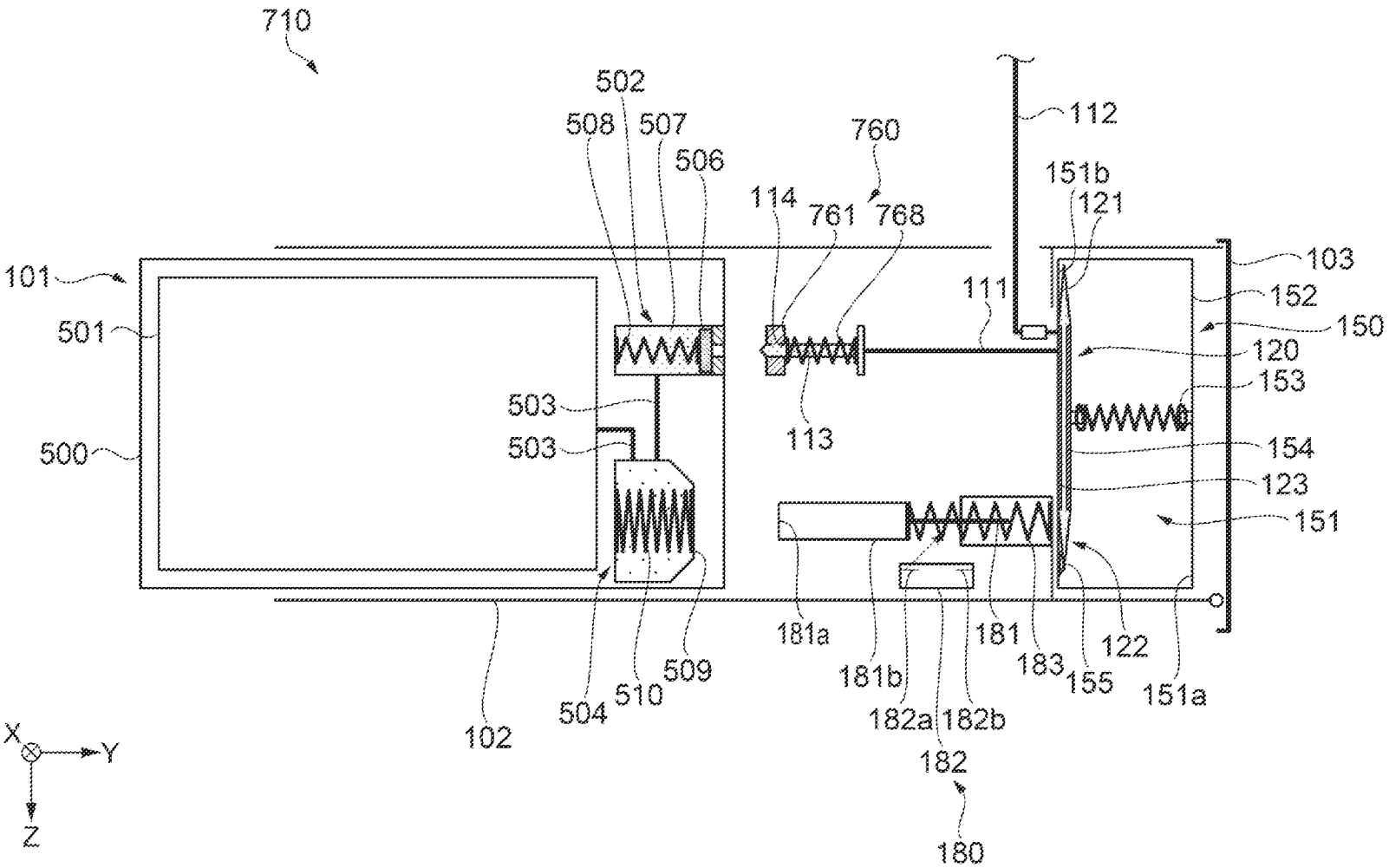
FIG. 13 is a schematic sectional view illustrating a decoupled state of a liquid supply source in the embodiment 3.

FIG. 12 is a schematic sectional view illustrating a liquid supply source holding portion of a liquid ejecting system according to the embodiment 3. FIG. 13 is a schematic sectional view illustrating a decoupled state of a liquid supply source according to the embodiment 3. A liquid ejecting system 710 is obtained by replacing the block mechanism 160 of the embodiment 1 with a block mechanism 760 illustrated in FIG. 12. Note that the components having the same configurations as those of the embodiment 1 are denoted by the same reference numerals, and overlapping descriptions will be omitted.

As illustrated in FIG. 12, the block mechanism 760 includes a cap member 761 that is slidable with respect to the outer peripheral surface of the coupling part 113. The cap member 761 moves from the open position for opening the liquid inflow opening 114 of the coupling part 113 to a cap position for capping the liquid inflow opening 114 in conjunction with the movement of the liquid supply source 101 from the coupling state to the decoupled state in a process of detaching the liquid supply source 101 from the liquid supply source holding portion 102.

The block mechanism 760 blocks the communication between the external space of the coupling part 113 and the liquid storage portion 120 with the cap member 761 capping the liquid inflow opening 114. Together with the first liquid channel 111 coupled with the liquid storage mechanism 150, the block mechanism 760 may be detachably provided to the liquid supply source holding portion 102 as a part of the liquid storage mechanism 150.

The block mechanism 760 may include a pushing spring 768 serving as a pushing member that pushes the cap member 761 from the open position toward the cap position. The cap member 761 is pushed by the pushing spring 768 such that it is movable between the cap position and the open position. As illustrated in FIG. 13, when the liquid supply source 101 is located at a position corresponding to the decoupled state, the cap member 761 is pushed by the pushing spring 768 and positioned at the cap position. As illustrated in FIG. 12, when the liquid supply source 101 is located at a position corresponding to the coupling state, the cap member 761 is pushed by the front surface of the housing case 500 and positioned at the open position.

As described above, the liquid ejecting system 710 and the liquid storage mechanism 150 according to the embodiment 3 can achieve the following effects.

The block mechanism 760 includes the cap member 761 that moves from the open position for opening the liquid inflow opening 114 of the coupling part 113 to the cap position for capping the liquid inflow opening 114 in conjunction with the movement of the liquid supply source 101 from the coupling state to the decoupled state, and blocks the communication between the external space of the coupling part 113 and the liquid storage portion 120, with the cap member 761 capping the liquid inflow opening 114. In this manner, the block mechanism 760 can block the communication between the external space of the coupling part 113 and the liquid storage portion 120 by capping the liquid inflow opening 114, and it is therefore not necessary to additionally provide a communication chamber to the first liquid channel 111 and/or the movement member.

The above-described embodiments and other embodiments described below can be combined with each other to the extent that they are not technically contradictory. Other embodiments are described below.

The liquid storage mechanisms 150 and 650 may be configured to generate a negative pressure in the liquid storage portion 120 by expanding the volume of the bag member 122 by displacing the flexible member 121 using a compression coil spring, a leaf spring or a mechanical element such as a lever disposed in the liquid storage portion 120, as an expansion member.

The liquid storage mechanisms 150 and 650 may not include the expansion member. In this case, the liquid storage portion 120 may be composed of an accordion-shaped container such that a negative pressure is generated in the liquid storage portion 120 by the rigidity of the accordion part when the storage amount of the liquid of the liquid storage portion 120 becomes smaller than a set predetermined amount.

The liquid storage mechanism 150 may be configured to include a pump that depressurizes the inside of the powder housing chamber 151 such that a negative pressure is generated in the liquid storage portion 120 by expanding the volume of the bag member 122 of the liquid storage portion 120 by depressurizing the outside of the liquid storage portion 120.

The predetermined storable amount of the set volume of the liquid storage portion 120 may not be the amount of the liquid that is expected to be required when one image is printed to the maximum printable size. When A represents the volume of the liquid pressure detection portion 504 that decreases while the pressure in the liquid pressure detection portion 504 provided in the liquid supply source 101 is changed from the first negative pressure to the third negative pressure, liquid of an amount corresponding to the volume A is supplied to the liquid ejecting portion 41 from the liquid supply source 101 from the time when the remaining amount of the liquid housed in the liquid supply source 101 becomes small until the amount of the liquid stored in the liquid storage portion 120 becomes small. In view of this, the predetermined storable amount of the liquid storage portion 120 may be set to a value obtained by subtracting the amount of the liquid corresponding to the volume A from the amount of the liquid that is expected to be required when one image is printed to the maximum printable size.

The predetermined storable amount of the set volume of the liquid storage portion 120 may not be the amount of the liquid that is expected to be required when one image is printed to the maximum printable size. For example, the predetermined storable amount of the liquid storage portion 120 may be set to the amount of the liquid required for continuing the printing for the time required for the replacement of the liquid supply source 101. In this manner, the printing can be continued using the liquid stored in the liquid storage portion 120 during the replacement of the liquid supply source 101, and the printing can be performed using the liquid housed in the new liquid supply source 101 after the replacement of the liquid supply source 101.

A plurality of the liquid storage mechanisms 150 and 650 including the liquid storage portions 120 with different storable liquid amounts may be provided and may be used by replacing the liquid storage mechanisms 150 and 650 mounted in the liquid supply source holding portion of the liquid supply apparatus 100 with them in accordance with the printing specification. For example, when the medium M is changed to a medium M with a large width and printing is continuously performed, the maximum printable size for one image is increased, and accordingly it is necessary to increase the set storage amount of the liquid storage portion 120. In addition, the medium M is changed from a sheet-shaped medium to a roll-shaped medium and long-length printing is performed, the maximum printable size for one image is increased even with the same width, and accordingly it is necessary to increase the set storage amount of the liquid storage portion 120. In this case, even when the remaining amount of the liquid of the liquid supply source 101 becomes small and the liquid supply source 101 has to be replaced during the printing, the liquid of a predetermined amount stored in the liquid storage portion 120 can be supplied to the liquid ejecting portion 41 and the printing of the image can be continued by using the liquid storage mechanisms 150 and 650 including the liquid storage portions 120 with different storable liquid amounts through the replacement in accordance with the printing specification.

The opening/closing valve 161 of the block mechanism 160 may be a solenoid valve that opens and closes the valve provided in the first liquid channel 111 serving as a supply path into the closed state that sets the first liquid channel 111 to the non-communication state and the open state that sets the first liquid channel 111 to the communication state with a solenoid, or may be an electric valve that opens and closes the valve with an electric motor. The opening/closing valve 161 may be a fluid pressure valve that opens and closes the valve with a hydropneumatic cylinder, or other control valves. The control portion 60 may control the opening/closing valve 161 on the basis of the light reception amount received by the light reception part 182*b* of the remaining amount detection sensor 182, and block the communication between the outside of the coupling part 113 and the liquid storage portion 120 when the decoupled state is achieved where the coupling state between the liquid supply source 101 and the coupling part 113 is released.

The opening/closing valve 661 of the block mechanism 660 may be a solenoid valve that opens and closes the valve provided in the first liquid channel 111 serving as a supply path into the closed state that sets the first liquid channel 111 to the non-communication state and the open state that sets the first liquid channel 111 to the communication state with a solenoid, or may be an electric valve that opens and closes the valve with an electric motor. The opening/closing valve 661 may be a fluid pressure valve that opens and closes the valve with a hydropneumatic cylinder, or other control valves. The control portion 60 may control the opening/closing valve 661 on the basis of the light reception amount received by the light reception part 682*b* of the second remaining amount detection sensor 682, and block the communication between the outside of the coupling part 113 and the liquid storage portion 120 when the amount of the liquid stored in the liquid storage portion 120 becomes small.

The liquid ejecting system 10 may be a liquid ejecting system that ejects and discharges liquid other than ink. Note that the state of the liquid discharged in the form of a very small amount of droplets from the liquid ejecting system includes granular, teardrop, and thread-like tails. In addition, it suffices that the liquid herein is a material that can be ejected from the liquid ejecting system. For example, it suffices that the substance is in the liquid phase, which includes fluids such as liquids with high or low viscosity, sols, gel water, other inorganic solvents, organic solvents, solutions, liquid resins, and liquid metals (metal melts). It also includes not only liquids as a state of a substance, but also particles of functional materials consisting of solids such as pigments and metal particles dissolved, dispersed, or mixed in a solvent. Typical examples of the liquids include various liquid compositions such as aqueous inks, non-aqueous inks, oil-based inks, gel inks and hot-melt inks, and liquid crystals, as described in the above embodiments. Specific examples of the liquid ejecting system include a liquid ejecting system that ejects liquids containing materials such as electrode materials and color materials in the form of dispersion or dissolution, which are used in the manufacture of liquid crystal displays, electroluminescent (EL) displays, surface emitting displays, and color filters. It is also possible to adopt a liquid ejecting system that ejects bio-organic materials used in biochip manufacturing, a liquid ejecting system used as a precision pipette that ejects liquid serving as a sample, a textile printing system, and a micro-dispenser. Further, it is also possible to adopt a liquid ejecting system that ejects lubricant with pinpoint accuracy onto precision machinery such as watches and cameras, and a liquid ejecting system that ejects a transparent resin liquid such as UV-curing resin onto a substrate in order to form micro-hemispherical lenses (optical lenses) used in optical communication devices. Further, it is also possible to adopt a liquid ejecting system that ejects an acid etchant, an alkali etchant and the like to etch a substrate.

What is claimed is:

1. A liquid ejecting system, comprising:

a liquid ejecting portion configured to eject liquid;

a liquid feeding mechanism configured to supply the liquid in a liquid supply source to the liquid ejecting portion through a liquid supply channel, the liquid feeding mechanism being provided in the liquid supply channel;

a liquid storage mechanism including a liquid storage portion configured to store the liquid supplied from the liquid supply source and provided between the liquid supply source and the liquid feeding mechanism in the liquid supply channel, wherein the liquid storage portion includes a flexible part having flexibility, the liquid storage mechanism is configured to generate a second negative pressure, larger than a first negative pressure, in the liquid storage portion based on a storage amount of the liquid in the liquid storage portion being smaller than a set predetermined amount, and the first negative pressure being a negative pressure that is generated in the liquid supply source when a remaining amount of the liquid in the liquid supply source becomes small;

a coupling part coupled with the liquid supply source to communicate the liquid supply source and the liquid storage portion through the liquid supply channel; and a block mechanism that includes:

an opening/closing valve between the coupling part and the liquid storage portion in the liquid supply channel, and configured to be set to an open state where an outside of the coupling part and the liquid storage portion are in communication and a closed state where the outside of the coupling part and the liquid storage portion are not in communication; and a movement member configured to move from a block release position for setting the opening/closing valve to the open state to a blocking position for setting the opening/closing valve to the closed state.

2. The liquid ejecting system according to claim 1, wherein the liquid storage mechanism includes an expansion member configured to deform the flexible part in a direction in which a volume in the liquid storage portion increases.

3. The liquid ejecting system according to claim 1, wherein the block mechanism is configured to block communication between the outside of the coupling part and the liquid storage portion when a decoupled state is achieved where a coupling state between the liquid supply source and the coupling part is released.

4. The liquid ejecting system according to claim 3, wherein the movement member is further configured to move from the block release position for setting the opening/closing valve to the open state to the blocking position for setting the opening/closing valve to the closed state in conjunction with a movement of the liquid supply source from the coupling state to the decoupled state.

5. The liquid ejecting system according to claim 3, wherein a liquid inflow opening through which the liquid from the liquid supply source flows in is provided in an outer peripheral surface of the coupling part; and the block mechanism includes:

a cap member provided to be slidable with respect to the outer peripheral surface of the coupling part, and configured to move from an open position for opening the liquid inflow opening to a cap position for capping the liquid inflow opening in conjunction with a movement of the liquid supply source from the coupling state to the decoupled state; and a pushing member configured to push the cap member from the open position toward the cap position.

6. A liquid storage mechanism, comprising:

a liquid storage portion provided between a liquid supply source and a liquid feeding mechanism in a liquid supply channel configured to supply liquid in the liquid supply source to a liquid ejecting portion configured to eject liquid, the liquid feeding mechanism being configured to feed the liquid toward the liquid ejecting portion, wherein the liquid storage portion includes a flexible part having flexibility and is configured to store the liquid supplied from the liquid supply source, the liquid storage mechanism is configured to generate a second negative pressure, larger than a first negative pressure, in the liquid storage portion based on a storage amount of the liquid in the liquid storage portion being smaller than a set predetermined amount, and the first negative pressure being a negative pressure that is generated in the liquid supply source when a remaining amount of the liquid in the liquid supply source becomes small;

a coupling part coupled with the liquid supply source to communicate the liquid supply source and the liquid storage portion through the liquid supply channel; and a block mechanism that includes:

an opening/closing valve between the coupling part and the liquid storage portion in the liquid supply channel, and configured to be set to an open state where an outside of the coupling part and the liquid storage portion are in communication and a closed state where the outside of the coupling part and the liquid storage portion are not in communication; and a movement member configured to move from a block release position for setting the opening/closing valve to the open state to a blocking position for setting the opening/closing valve to the closed state.

7. The liquid storage mechanism according to claim 6, comprising an expansion member configured to deform the flexible part in a direction in which a volume in the liquid storage portion increases.

8. The liquid storage mechanism according to claim 6, wherein the block mechanism is configured to block communication between the outside of the coupling part and the liquid storage portion when the liquid supply source is detached and a decoupled state is achieved where a coupling state between the liquid supply source and the coupling part is released.

9. The liquid storage mechanism according to claim 8, wherein the the movement member is further configured to move from the block release position for setting the opening/closing valve to the open state to the blocking position for setting the opening/closing valve to the closed state in conjunction with a movement of the liquid supply source from the coupling state to the decoupled state.

10. The liquid storage mechanism according to claim 8, wherein a liquid inflow opening through which the liquid from the liquid supply source flows in is provided in an outer peripheral surface of the coupling part; and the block mechanism includes:

a cap member provided to be slidable with respect to the outer peripheral surface of the coupling part, and configured to move from an open position for opening the liquid inflow opening to a cap position for capping the liquid inflow opening in conjunction with a movement of the liquid supply source from the coupling state to the decoupled state; and a pushing member configured to push the cap member from the open position toward the cap position.

11. A liquid ejecting system, comprising:

a liquid ejecting portion configured to eject liquid;

a liquid feeding mechanism configured to supply the liquid in a liquid supply source to the liquid ejecting portion through a liquid supply channel, the liquid feeding mechanism being provided in the liquid supply channel;

a liquid storage mechanism including a liquid storage portion configured to store the liquid supplied from the liquid supply source and provided between the liquid supply source and the liquid feeding mechanism in the liquid supply channel, wherein the liquid storage portion includes a flexible part having flexibility, the liquid storage mechanism generates a second negative pressure, larger than a first negative pressure, in the liquid storage portion when a storage amount of the liquid in the liquid storage portion becomes smaller than a set predetermined amount, and the first negative pressure being a negative pressure that is generated in the liquid supply source when a remaining amount of the liquid in the liquid supply source becomes small;

a coupling part coupled with the liquid supply source to communicate the liquid supply source and the liquid storage portion through the liquid supply channel; and a block mechanism that includes:

an opening/closing valve between the coupling part and the liquid storage portion in the liquid supply channel, and configured to be set to an open state where an outside of the coupling part and the liquid storage portion are in communication and a closed state where the outside of the coupling part and the liquid storage portion are not in communication; and a movement member configured to move from a block release position for setting the opening/closing valve to the open state to a blocking position for setting the opening/closing valve to the closed state in conjunction with a movement of the liquid supply source from a coupling state to a decoupled state.

* * * * *